US006323809B1

(12) United States Patent
Maloney et al.

(10) Patent No.: US 6,323,809 B1
(45) Date of Patent: Nov. 27, 2001

(54) FRAGMENTED APERTURE ANTENNAS AND BROADBAND ANTENNA GROUND PLANES

(75) Inventors: James Geoffrey Maloney, Marietta; Morris Philip Kesler, Douglasville; Paul H. Harms; Glenn Stanley Smith, both of Atlanta, all of GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 09/579,560

(22) Filed: May 26, 2000

Related U.S. Application Data

(60) Provisional application No. 60/136,721, filed on May 28, 1999.

(51) Int. Cl.[7] ..... H01Q 1/38
(52) U.S. Cl. ..... 343/700 MS; 343/846
(58) Field of Search ..... 343/700 MS, 846, 343/844, 853, 829, 770

(56) References Cited

U.S. PATENT DOCUMENTS 4,728,805 3/1988 Dempsey ..... 250/578
5,001,493 * 3/1991 Patin et al. ..... 343/700 MS
5,262,790 * 11/1993 Russo ..... 343/700 MS
5,719,794 2/1998 Altshuler et al. ..... 364/578
5,912,645 * 6/1999 Wight et al. ..... 343/700 MS

* cited by examiner

*Primary Examiner*—Hoanganh Le
*Assistant Examiner*—Hoang Nguyen
(74) *Attorney, Agent, or Firm*—Thomas, Kayden, Horstemeyer & Risley LLP

(57) ABSTRACT

The present invention provides a fragmented aperture antenna. The antenna includes a planar layer having a plurality of conductive and substantially non-conductive areas. Each area has a periphery that extends along a grid of first and second sets of parallel lines so that each area comprises one or more contiguous elements defined by the parallel lines. The locations of the conducting materials in the fragmented aperture antenna are determined by a multi-stage optimization procedure that tailors the performance of the antenna to a particular application. The resulting configuration and arrangement of conductive and substantially non-conductive areas enable communication of electromagnetic energy wirelessly in a specific direction to the planar layer when an electrical connection is made to at least one of the conductive areas.

35 Claims, 31 Drawing Sheets

RANDOM PATTERN OF CONDUCTING AND NON-CONDUCTING ELEMENTS.

RANDOM PATTERN OF CONDUCTING AND NON-CONDUCTING ELEMENTS.

16

FRAGMENTED ATENNA APERTURE OPTIMIZED TO OPERATE
FROM 800 MHZ TO 2.5 GHZ SYSTEM GAIN

30

MEASURED AND PREDICTED PERFORMANCE FOR ANTENNA 20

64

H-PLANE GRAPH

FRAGMENTED APERTURE ANTENNA OPTIMIZED OVER THE 0.24 - 2.04 GHZ FREQUENCY RANGE TO ACHIEVE A SYSTEM GAIN THAT FOLLOWS THE UNIFORM APERTURE LIMIT.

75

MEASURED AND PREDICTED PERFORMANCE OF ANTENNA 75

80

FRAGMENTED APERTURE ANTENNA OPTIMIZED OVER A 1.4 – 1.8 GHZ FREQUENCY RANGE

MEASURED AND PREDICTED PERFORMANCE OF ANTENNA 81

83

FRAGMENTED APERTURE ANTENNA OPTIMIZED FOR DUAL POLARIZATION OVER A 1.4 - 1.8 GHZ FREQUENCY RANGE

90

92

ANTENNA WITH A GROUND PLANE LAYER

RADIATING APERTURE

GROUND PLANE LAYERS

DESIGNED BASED ON RADIATING APERTURE 108

DESIGNED BASED ON A SOLID METAL SHEET

PERFORMANCE OF THE FRAGMENTED APERTURE ANTENNA WITH AND WITHOUT THE GROUND PLANES

112 OPTIMIZED REFLECTOR (PATTERNED INITIAL)
114 OPTIMIZED REFLECTOR (SOLID INITIAL)
116 WITH NO REFLECTOR
111 UNIFORM APERTURE LIMIT

104

3 CONNECTED PERCOLATING ARRAY ELEMENT

135

SWITCHED APERTURE ANTENNA ELEMENT 1.4 - 1.8 GHZ BROADSIDE SWITCHED APERTURE ANTENNA

160

170

1.4 - 1.8 GHZ ANTENNA FOR 30 DEGREE STEERING

185

H-PLANE RADIATION PATTERN AT 1.8 GHZ

195

SUMMARY OF SYSTEM GAIN PERFORMANCE FOR THE THREE SWITCHED APERTURE ELEMENT CONFIGURATIONS

200

SCHEMATIC REPRESENTATION OF A CONNECTED ARRAY OF RECONFIGURABLE APERTURE ELEMENTS

FRAGMENTED APERTURE ANTENNA CREATED IN SCREEN PRINTING TECHNIQUE

FRAGMENTED APERTURE ANTENNAS AND BROADBAND ANTENNA GROUND PLANES

CLAIM OF PRIORITY

This application claims priority to copending U.S. Provisional Application entitled, "Fragmented Aperture Antennas and Broadband Antenna Ground Planes," having Ser. No. 60/136,721, filed May 28, 1999, which is entirely incorporated herein by reference.

GOVERNMENT LICENSE RIGHTS

The U.S. Government has a paid-up license in this invention and the right in limited circumstances to require the patent owner to license others on reasonable terms as provided for by the terms of contract No. XXXXXX-97-C-1229 awarded by the Department of Defense of the United States of America. The prefix XXXXXX is classified confidential.

FIELD OF THE INVENTION

This invention relates in general to the field of broadband antennas, and more particularly, to fragmented aperture antennas with tailored electromagnetic performances.

BACKGROUND OF THE INVENTION

An antenna is a device that can both transmit and receive electromagnetic waves of energy. Designing an antenna can be a complicated task because of the inherent properties of electromagnetics. Presently, antenna engineers physically scale or modify conventional antennas to best meet a particular application. However, in many instances, this procedure is suboptimal because a suitable conventional antenna may not exist or is not similar enough to meet a particular need. Antennas with broadband frequency coverage are desirable so the antenna can operate in a greater number of applications, but many conventional antennas with broadband coverage also include inadequacies that render them ultimately unacceptable.

For example, a multi-turn spiral antenna is a broadband antenna. However, the gain of the spiral antenna is essentially flat with frequency. The optimal use of the aperture area would yield a gain that increases with frequency, so the spiral antenna is suboptimal from because of its increases in gain over frequency.

Another example of a broadband antenna is the bow-tie antenna. A bow-tie antenna will radiate over a wide range of frequencies. Because the direction of radiation for the bow-tie antenna changes over the range of frequency, this feature renders the bowtie as suboptimal.

Thus, there is a need for an antenna that can overcome these limitations, deficiencies and inadequacies that is heretofore unaddressed.

SUMMARY OF THE INVENTION

Briefly described, the preferred embodiment of the present invention provides a new family of antennas—fragmented aperture antennas. The antenna includes a planar layer having a plurality of conductive and substantially non-conductive areas. Each area has a periphery that extends along a grid of first and second sets of parallel lines so that each area comprises one or more contiguous elements defined by the parallel lines. The locations of the conducting materials in the fragmented aperture antenna are determined by a multi-stage optimization procedure that tailors the performance of the antenna to a particular application. The resulting configuration and arrangement of conductive and substantially non-conductive areas enable communication of electromagnetic energy wirelessly in a specific direction to the planar layer when an electrical connection is made to at least one of the conductive areas.

The present invention can also be viewed as providing one or more methods. As an example, one such method is for making an antenna. The method includes a step of defining a planar grid defined by first and second sets of parallel lines so that the grid comprises a plurality of elements defined by the lines. The method additionally includes determining a first plurality of said elements that should be substantially conductive and a second plurality of said elements that should be substantially nonconductive so that a hypothetical antenna formed from said planar grid elements exhibits a desired frequency spectrum.

In an alternative embodiment, a broadband ground plane is created by using a similar optimization strategy as described above. The fragmented ground plane is a second patterned sheet placed behind the radiating layer to reflect the energy in the forward direction of the antenna. The fragmented ground plane is a patterned layer similar to the radiating antenna aperture. A feed is applied to the radiating aperture, and the ground plane layer is placed in parallel to the radiating aperture at a predetermined distance.

The single fragmented aperture antenna as described above may also be placed in an array of multiple antenna elements. In an alternative embodiment, the fragmented aperture antennas configured in the array environment are allowed, through the optimization process, to physically touch neighboring antenna elements, thereby creating a connected array. To create the connected antenna array, a suitable antenna element is selected and then the spacing and size are chosen such that no grating lobes exist and that the required array gain is met. In the connected array, the individual antenna array elements may physically touch, so the embedded array behavior does not resemble the isolated antenna behavior. By allowing the individual antenna array elements to touch, the low frequency limit of operation is not set by the size of the isolated elements, but rather, it is set by the size of the array antenna.

Another embodiment of the invention realizes a reconfigurable aperture and achieves multiple fragmented aperture designs from a single aperture. The reconfigurable aperture is comprised of conducting elements and configurable switches that may be opened or closed to create a fragmented antenna. The switches may be configured to steer the emitted energy at some predetermined angle from broadside.

In yet another alternative embodiment, the switched aperture antenna may be constructed in a connected array such that a large configurable aperture is comprised of an array of identically smaller, reconfigurable elements. The switched fragmented aperture array structure is a connected array similar to the connected non-switched arrays as discussed above. Metal patches are connected by closed switches to form the antenna array. A separate feed patch feeds each antenna element of the array. In the switched fragmented aperture array, the antenna elements in the array may physically touch; hence, the embedded array behavior does not resemble the isolated antenna behavior. Different configurations of a configurable array can operate broadband for a particular set of beam widths and steering angles, and the configuration of each array element can be changed from different beam widths and steering angles.

Many antennas, methods, features, and advantages of the present invention will become apparent to one with skill in the art upon examination of the following drawings and detailed description.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION OF THE PREFERRED EMBODIMENT

Figure 1:
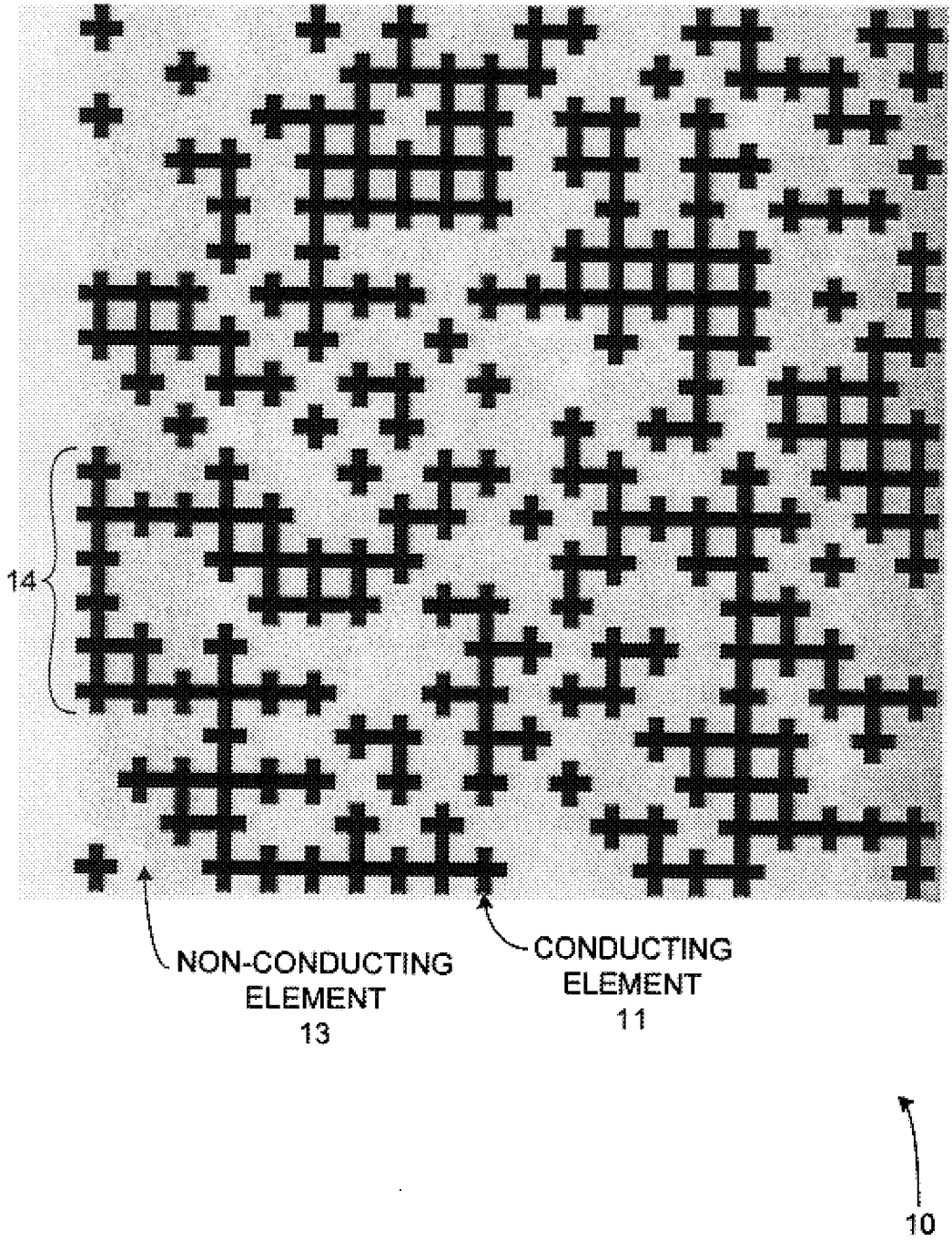
FIG. 1 is a diagram of an antenna having pattern structures of conducting and substantially non-conducting elements utilizing the notion of percolation physics.

FIG. 1 is a diagram of an antenna design structure 10 involving pattern structures of conducting and substantially non-conducting elements 11, 13 and utilizing the notion of percolation physics. Dark regions 11 represent conducting material while light regions 13 represent substantially non-conducting material. Conducting material may be any material that has a higher conductivity than the substantially non-conducting material. As a non-limiting example, the conducting material may be a material with semi-conducting qualities, and the substantially non-conducting material may be any type of dielectric material.

Each site that is occupied by conducting material 11 has probability, $p_c$. When $p_c$ approaches a critical value, the percolation threshold, long chains 14 are likely to be formed in the structure 10. For occupation probabilities greater than this threshold, there will be a continuous chain across the structure enabling direct current (DC) conduction to occur.

Figure 2:
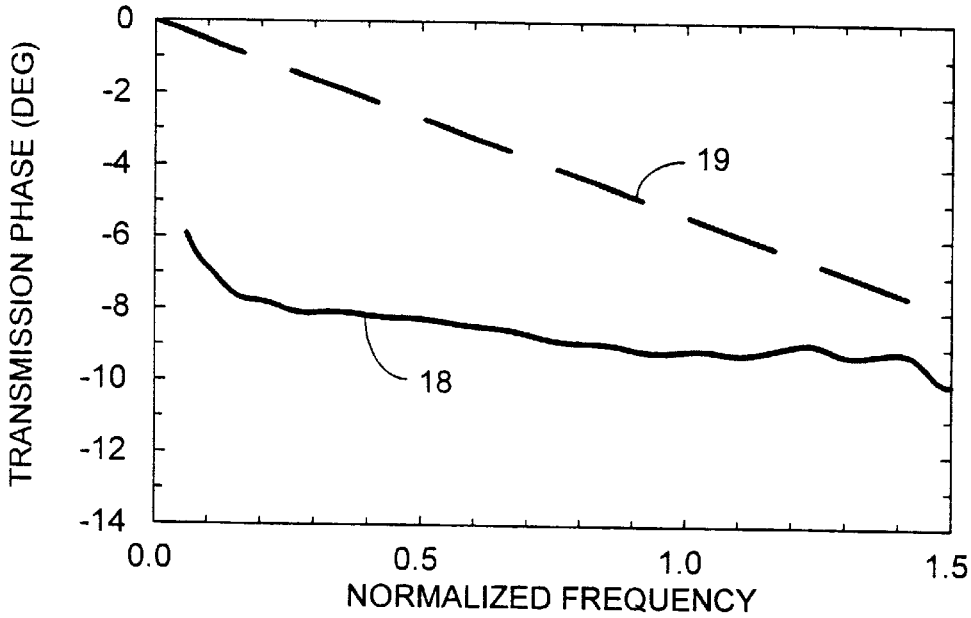
FIG. 2 is a diagram depicting the phase of the plane wave transmission coefficient for the antenna of FIG. 1 compared to that of a homogenous dielectric sheet.

Near the percolation threshold, conducting chains 14 are created having a variety of lengths. These chains resonate at a wide range of frequencies and cause the structure 10 to have a broadband response. FIG. 2 is a graphical diagram 16 depicting the phase of the plane wave transmission coefficient 18 for the antenna design 10 (FIG. 1) compared to that of a homogenous dielectric sheet 19. The transmission phase response 18 of the percolating structure 10 is relatively flat across a wide frequency band. In contrast, the homogenous material 19 exhibits a linear phase variation with frequency. The flat transmission phase 18 of the percolating structure 10 is a result of the wide variety of length scales represented in the structure 10. Thus, this structure 10 is useful as a broadband antenna and is hereinafter referred to as a fragmented aperture antenna.

Figure 3:
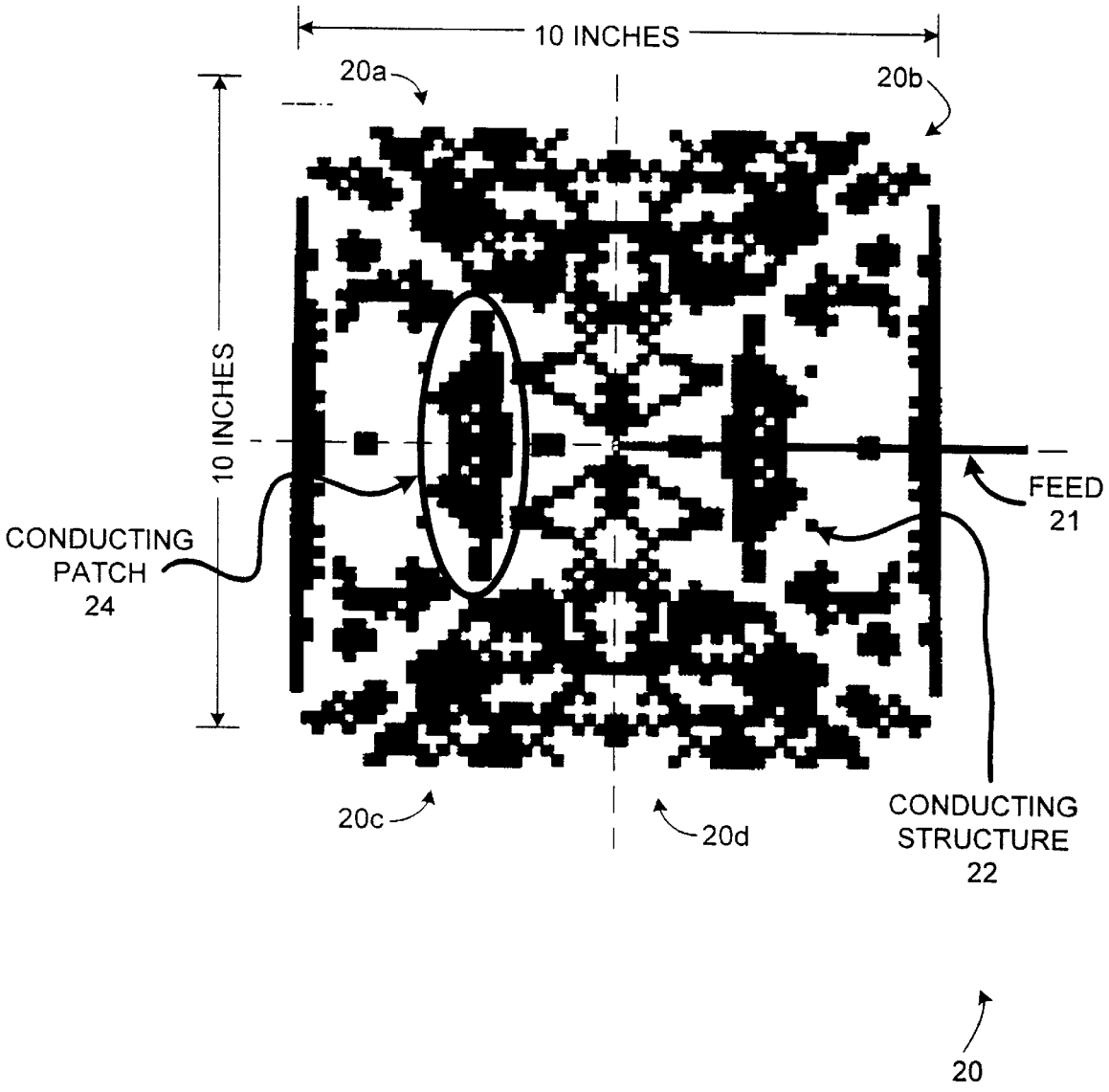
FIG. 3 is a diagram of a fragmented aperture antenna optimized to operate from 800 MHz to 2.5 GHz with flat 6 dB system gain.

FIG. 3 is a diagram of a fragmented aperture antenna 20, as a non-limiting example, optimized to operate from 800 MHz to 2.5 GHz with flat 6 dB system gain. Antenna 20 is a square planar aperture of side length 10 inches and includes conducting structures arranged in isolation 22 and in patches 24. The conducting structures are arranged in a grid wherein groups of the structures create the conducting patches 24.

To use the pattern structure 20 as shown in FIG. 3 as an antenna, the energy gets out of the structure 20 through one or more feed points. It is desirable, however, to have as few feed points as possible. In one embodiment, feed points may be added to a fixed pattern after determining possible locations that would serve as good locations for the feed points. Criteria for placement of feed points may include places of high current flow. In the preferred embodiment, feed points may be placed in a fixed position and different antenna patterns may be configured to reach the desired performance.

One non-limiting example of the preferred embodiment for designing a fragmented aperture antenna is to place a feed 21 at the center of a 10 inch aperture and search for patterns that yield the desired antenna performance. In this embodiment, the antenna 20 is fed by a single, centrally located transmission line 21 of characteristic impedance 100 Ohms. Quadrant symmetry of the pattern 20*a*, 20*b*, 20*c*, 20*d* is assumed so that linear polarization results in the direction broadside to the aperture. The conducting element size is chosen so that a 31×31 array fits within each quadrant 20*a*, 20*b*, 20*c*, 20*d*. Numerous random selected patterns are then evaluated for broadside gain as a function of frequency. This random search results in some suitable antennas; however, a more optimized search strategy is required.

This preferred embodiment of the invention implements a multi-stage optimization approach to design the fragmented aperture antennas, such as antenna 20 in FIG. 3. In designing the antenna 20, the objective is to obtain the maximum system gain in the broadside direction over a specified, relatively wide bandwidth. System gain includes any loss due to impedance mismatch. The antenna 20 is assumed to have reflection symmetry about two orthogonal planes. Additionally, the radiating structure of the antenna 20 is optimized using a modified genetic algorithm approach. Each quadrant (i.e., 20*a*) of the antenna 20 is a lattice of 31×31 square patches wherein each patch on the dielectric substrate can either be metallic or non-metallic. Thus, each quadrant 20*a*–20*d* has 961 degrees of freedom ($2^{961}=10^{289}$ possible antennas). A direct genetic optimization with 961 binary genes exhibits very poor convergence as it is impractical to use a genetic algorithm directly in this 961 bit space because of computational requirements.

Implementing a two-step process, however, improves the convergence rate. The first stage implements a direct genetic optimization using a large-scale characterization of the antenna aperture 20—typically 40 genes. The second stage is a stochastic hill climb optimization using the fine scale characterization—961 degrees of freedom for a typical 31×31 aperture (which is one quadrant (i.e., 20*a*) of the antenna aperture 20). Briefly described, a simple stochastic hill climb consists first selecting a location in the aperture $$$at random. The bit at this location is toggled—in effect changing this location from free space to metal or metal to free space. This candidate antenna is evaluated. If the antenna is better than the previous antenna, then this change is retained. Otherwise, the antenna is returned to its previous state. This process is repeated many times until the rate of improvements practically stops. Alternatively, a genetic algorithm method similar to that as disclosed in U.S. Pat. No. 5,719,794, which discloses a method for designing wire antenna configurations and is herein incorporated by reference, may be implemented for design of fragmented aperture antennas. Moreover, other advanced hill climb procedures may also be used. These advanced methods include selecting multiple locations in the aperture and/or changing more than a single bit. Nevertheless, the stochastic hill climb is a random walk toward a more optimal antenna. This two-step approach exhibits acceptable rates of convergence and is described in more detail hereinafter.

Figure 4:
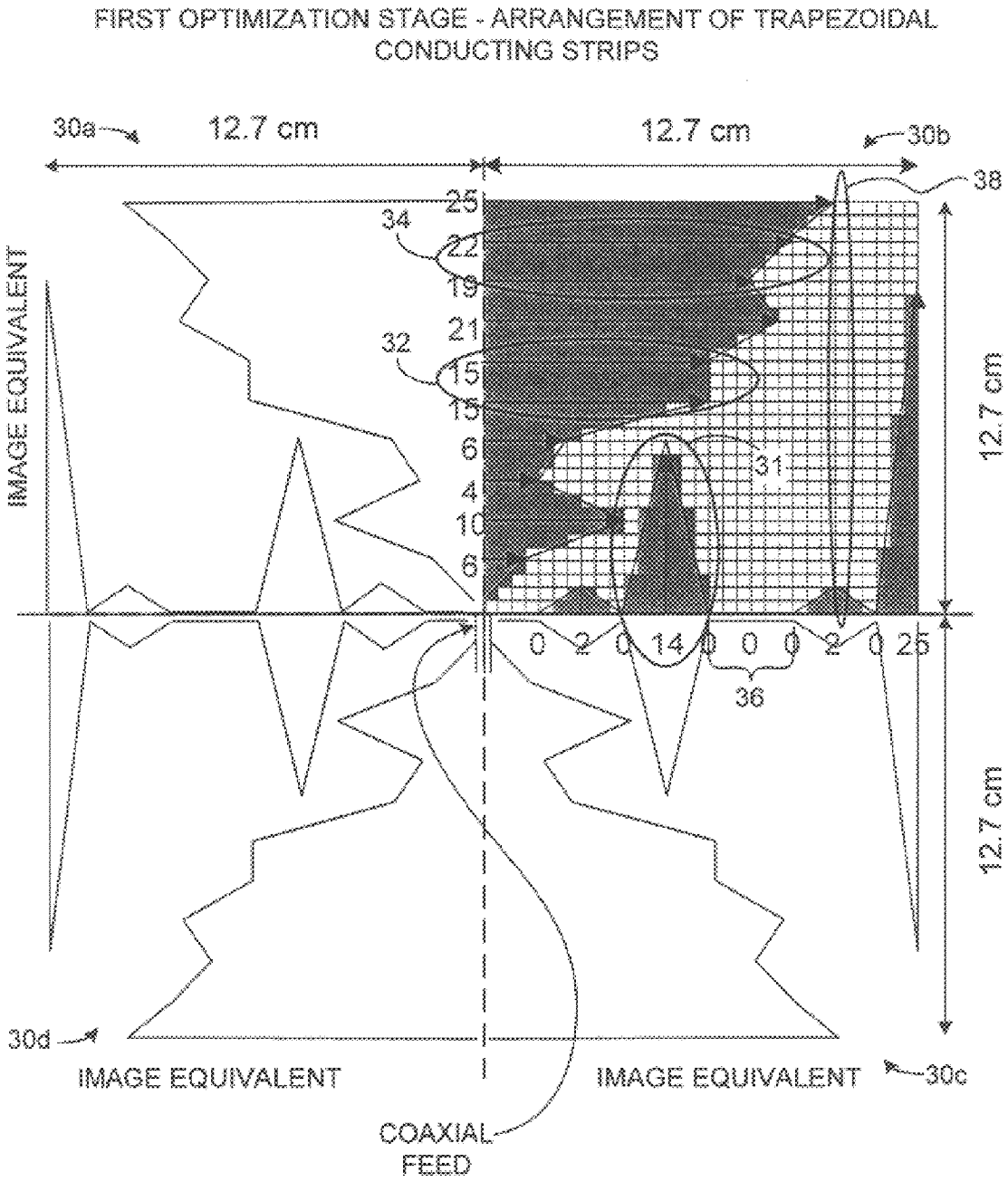
FIG. 4 is a diagram of a set of trapezoidal conducting strips arranged in fixed locations to provide a coarse description of the antenna ultimately developed as shown in FIG. 3.

The first stage of optimization process, to obtain a uniform antenna system gain over a desired frequency range, requires a description of potential antennas with a smaller number of binary digits than the full 961 required for the 31×31 aperture. FIG. 4 is a diagram of a set of trapezoidal conducting strips 30 arranged in fixed locations to provide a coarse description of the antenna 20 ultimately developed as shown in FIG. 3. The coarse description of the antenna composed of the conducting strips is comprised of four quadrants 20*a*, 20*b*, 20*c*, 20*d*. With additional reference to the flowchart 40 in FIGS. 5 and 6, which show the two-step optimization process, a set of trapezoidal conducting strips are arranged in fixed locations in a quadrant (i.e., 20*b* (FIG. 4)) to provide a coarse description of the antenna 20 (FIG. 3), as in step 41. Binary genes describe the length of two opposite sides of the trapezoids 30 (FIG. 4), so that the conducting strip could be, for example, a triangular region 31 (FIG. 4) (one side equal to zero), a rectangular region 32 (FIG. 4) (both sides equal), a general trapezoid 34 (FIG. 4) (unequal but non-zero sides) or non-present 36 (FIG. 4) (both sides equal to zero). The term binary genes represents genes that consist of a series of bits; for example, a gene that consists of 5 bits has $2^5$ =32possible states. In the non-limiting example, the length of a side 38 may be represented as 32 possible lengths (between 0 to 31); therefore, five bits are needed in this non-limiting example to prescribe a given strip, as described in step 43. In this embodiment, a typical antenna may contain 10 to 20 strips, so a total of 50 to 100 bits describes the antenna for the first stage of the optimization process, as shown in step 45.

Once the genetic optimization is performed using the large-scale description of the aperture distribution as described above, a fine-scale optimization process is performed, as in step 47. This process uses the full description of the antenna (961 bits for the 31×31 aperture). The fine-scale optimization process makes a minor modification to the antenna design and then compares the performance of the new antenna to that of the genetically optimized antenna. A random location in the antenna is selected, as in step 48, and a determination is made of whether the site contains a conductor, as in step 49. If the selected site contains a conductor 22 (FIG. 3), as in step 51, the conductor is removed and the performance of the resulting antenna is computed, as in step 53. If the site did not originally contain a conductor 22 (FIG. 3), as in step 54, one is added and the performance is likewise computed, as in step 53. If, as in step 56, it is determined that the new antenna performs better than the initial antenna, it is kept, as in step 58. Otherwise, as in step 59, the initial antenna is retained if a determination is made in step 56 that the initial antenna outperforms the resulting antenna. The optimization process may be repeated as many times as desired or until no further improvements are found, as shown in step 60. Ultimately, a final antenna design is rendered, as in step 62. This procedure can dramatically change the appearance of the conductor distribution in the aperture and typically results in a 3 dB improvement in the antenna performance.

Figure 7:
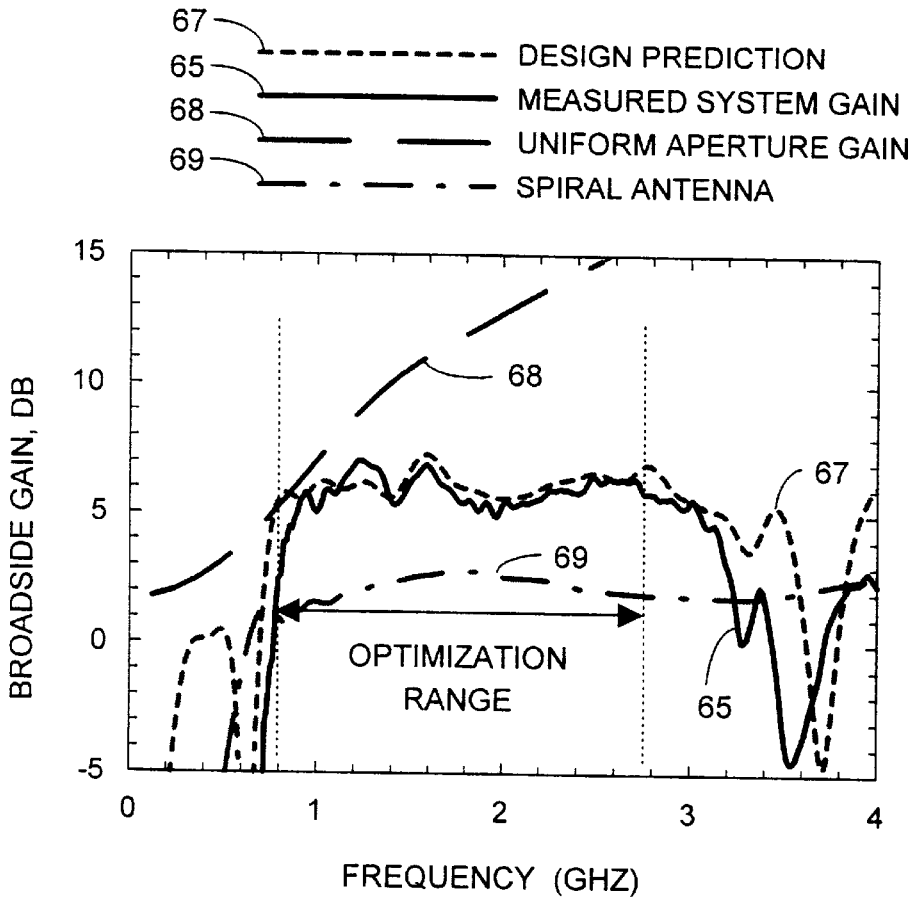
FIG. 7 is a diagram of the predicted and measured performance of the antenna radiating structure in FIG. 3.

FIG. 7 is a diagram of the predicted and measured performance 64 of the antenna radiating structure 20 in FIG. 3 that was optimized using the two-stage process described above to yield the best broadside system gain over the frequency span of 800 MHz to 2.5 GHz. System gain 65 is defined as directive gain times mismatch. Directive gain is the ideal gain of the antenna that is in the direction of maximum radiation, and mismatch accounts for the difference between the load impedance and the generator impedance of the communicating system. Because the optimization includes the effect of mismatch, the Voltage Standing Wave Ratio (VSWR) of the designed antenna is directly constrained. Thus, the measured system gain 65 for the antenna 20 is compared with the design prediction 67 for the same antenna. Predicted results 67 are generated using a numerical code based on the Finite-Difference Time-Domain (FDTD) Method.

Additionally, the system gain 65 is seen to be relatively flat across the frequency region that extends beyond the design bandwidth at the high end. Line 68 represents the directivity of an aperture of the same area with a uniform distribution of current, and line 69 represents the gain of a spiral antenna (not shown). Since the optimization process attempts to achieve a flat gain, the result is limited by the lowest frequency in the band of operation as evidenced by the fact that the system gain 65 is fixed to be the same as the directivity of the uniform current 68 at the lower end of this specified frequency range. Thus, it is desirable to search for designs whose gain over frequency attempts to mimic the uniform aperture gain 68 instead of a flat gain as evidenced by the measured system gain 65.

Figure 8:
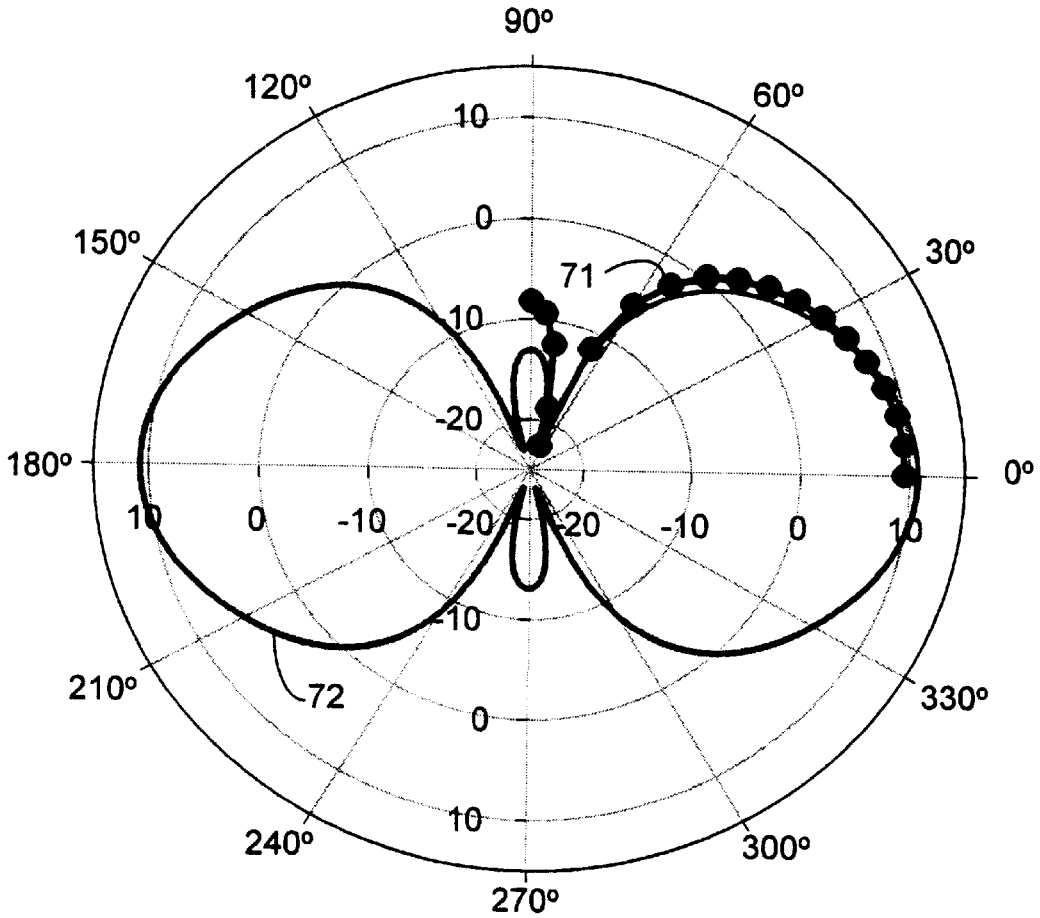
FIG. 8 is a graph of the measured H-plane radiation pattern of the antenna in FIG. 3 as compared to the design prediction.
Figure 8:
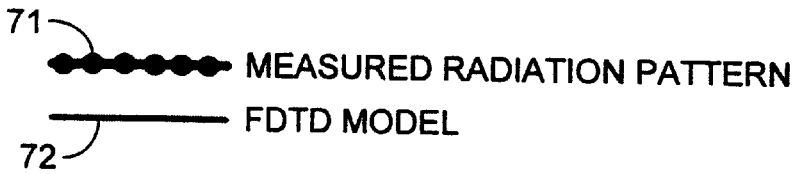
Figure 8:
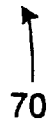

FIG. 8 depicts graph 70 which is the measured H-plane radiation pattern 71 of antenna 20 (FIG. 3) compared to the design prediction 72. As corroboration to the graph of antenna 20 in FIG. 7, the radiation pattern 71 is directed in the broadside direction as designed.

Figure 9:
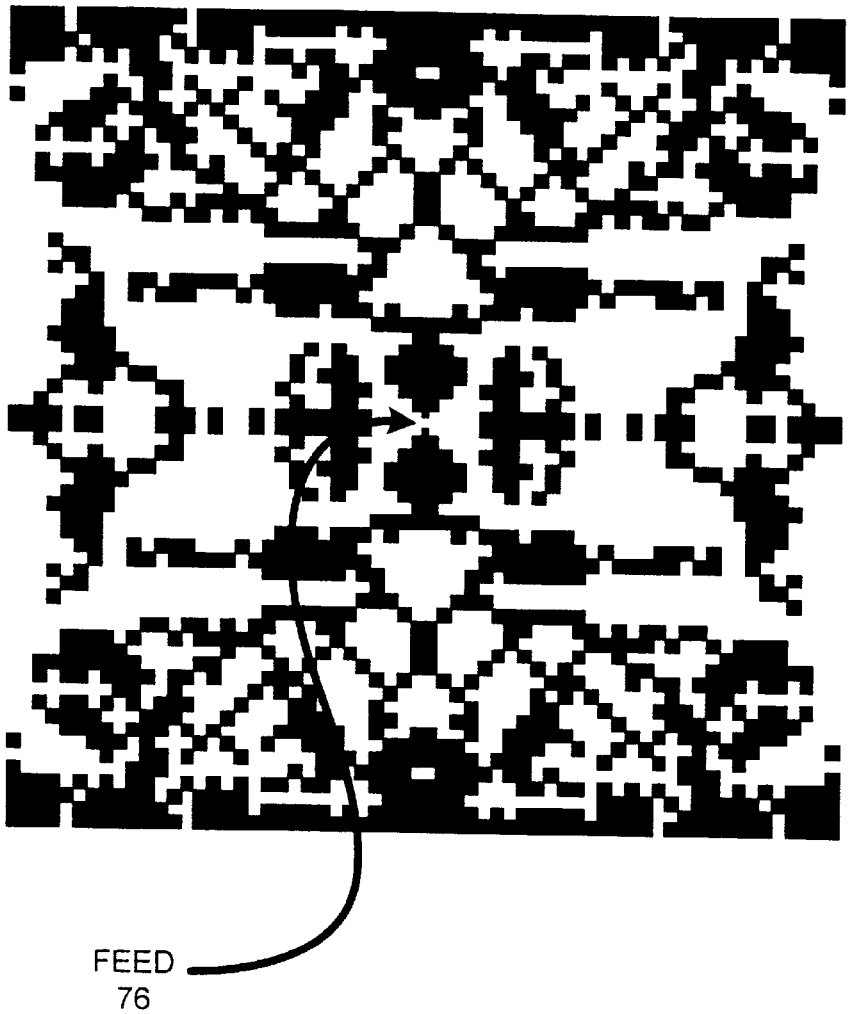
FIG. 9 is a diagram of a fragmented aperture antenna over a 0.4–2.04 GHz optimized frequency range to achieve a system gain that follows the uniform aperture limit and was designed by the two-step optimization process shown in FIGS. 5 and 6.

FIG. 9 is a diagram of a fragmented aperture antenna 75 optimized over a 0.4–2.04 GHz frequency range to achieve a system gain that follows the uniform aperture limit. Antenna 75 is fed centrally by feed 76 and is quadrantly symmetrical similarly to antenna 20 in FIG. 3. Antenna 75 is a result of the two-step optimization process as described above, and as shown in FIGS. 5 and 6.

Figure 10:
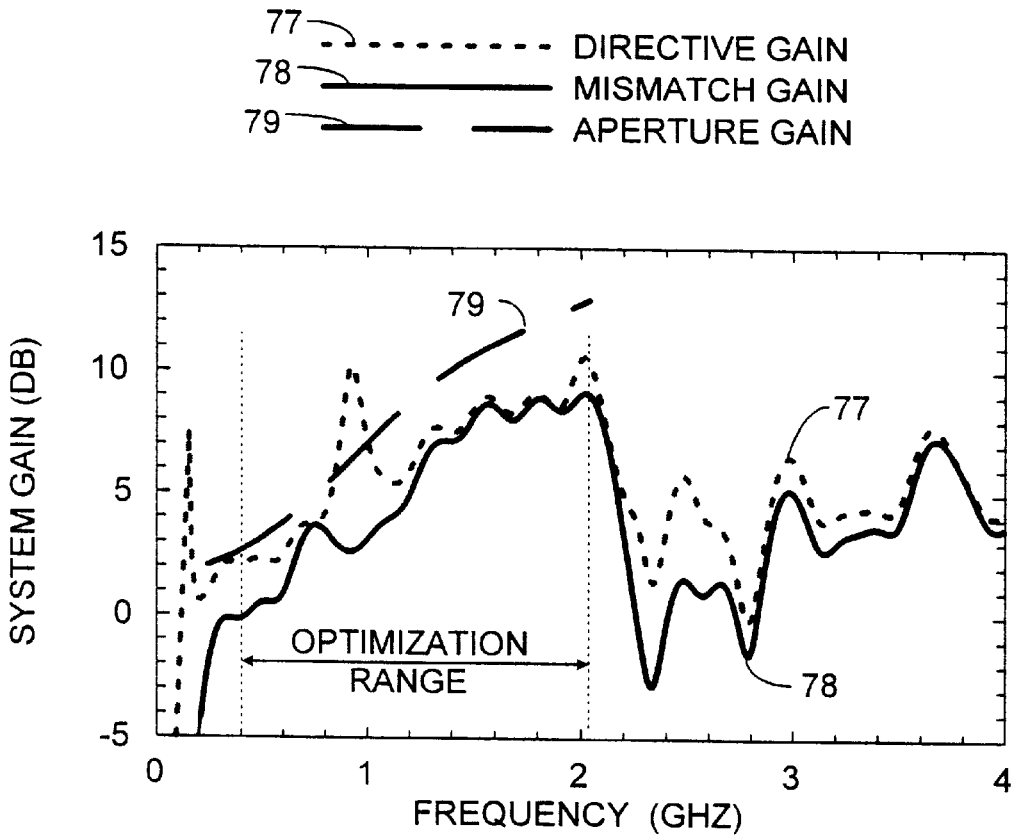
FIG. 10 is a graph of the predicted performance of the antenna in FIG. 9 showing the directive gain, system mismatch gain and uniform aperture gain.

FIG. 10 is a graph 80 of the predicted performance of antenna 75 in FIG. 9 showing the directive gain 77, system mismatch gain 78 and uniform aperture gain 79. The system mismatch gain 78 tracks the uniform aperture limit 79 within a few dB over the optimization range. As evidenced from the fragmented aperture antenna 75 in FIG. 9, the genetic algorithm placed metal conductors near the top and bottom edges of the aperture 75 in an attempt to use the full aperture to enhance the low-frequency performance. The directive gain 77 is shown in FIG. 10 which factors out mismatch loss of the antenna 75. Over most of the frequency region, the directive 77 and system mismatch gains 78 are almost identical, indicating a good impedance match for the antenna. However, the peak in the directive gain 77 at 1 GHz shows how the optimization process allowed a larger mismatch loss at a point where it could achieve a higher directive gain 77.

Figure 11:
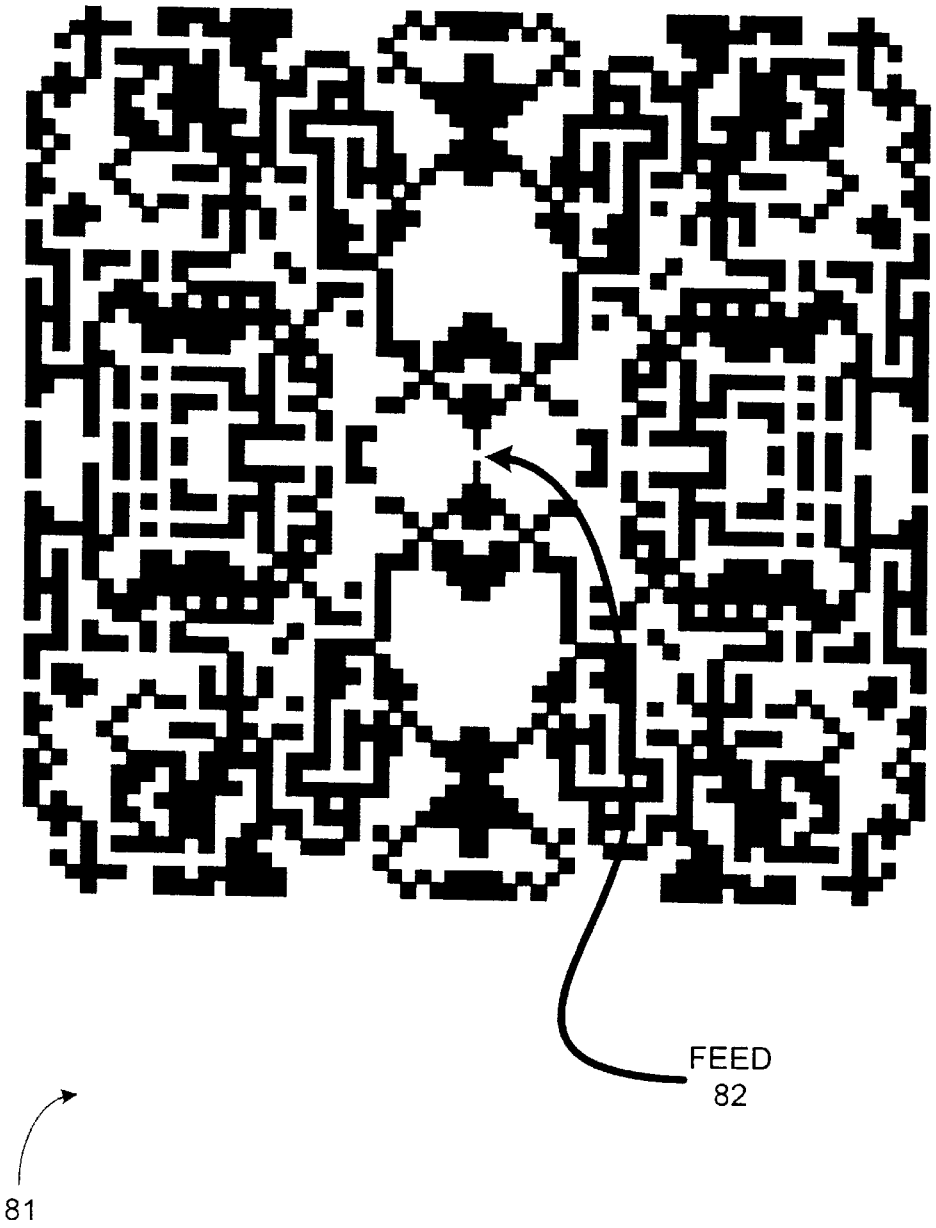
FIG. 11 is a diagram of a fragmented aperture antenna designed by the two-step optimization process shown in FIGS. 5 and 6 and optimized over a 1.4–1.8 GHz frequency range to achieve a system gain that follows the uniform aperture limit.

FIG. 11 is a diagram of a fragmented aperture antenna 81 optimized over a 1.4–1.8 GHz frequency range to achieve a system gain that follows the uniform aperture limit. Antenna 81 is fed centrally by feed 82 and is quadrantly symmetrical. The frequency design is 1.3:1 to cover the 1.4–1.8 GHz frequency range.

Figure 12:
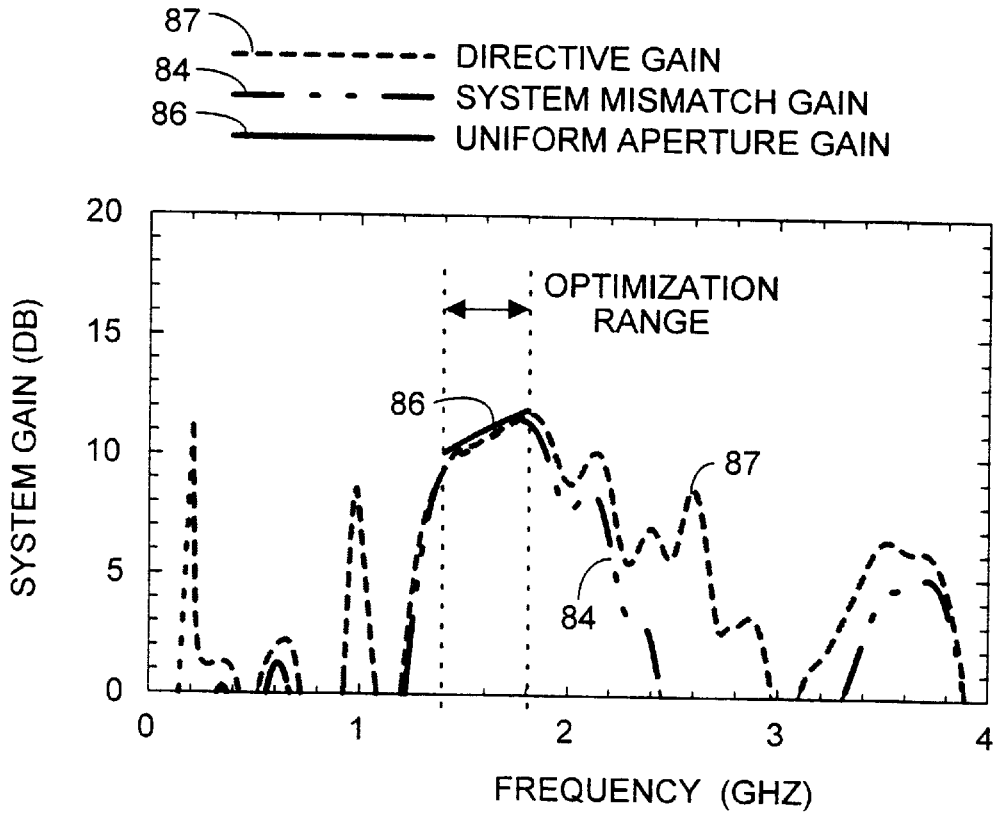
FIG. 12 is a graph of the performance for the antenna displayed in FIG. 11.

FIG. 12 is a graph 83 of the performance for the antenna 81 as displayed in FIG. 11. For antenna 81, the system gain 84 in the broadside direction is very close to the uniform aperture limit 86. The antenna 81 (FIG. 11) is well matched over the design bandwidth as evidenced by the system and directive gains 84, 87 being essentially the same. As evidenced by graph 83, the antenna performance falls off rapidly outside the optimization region.

Figure 13:
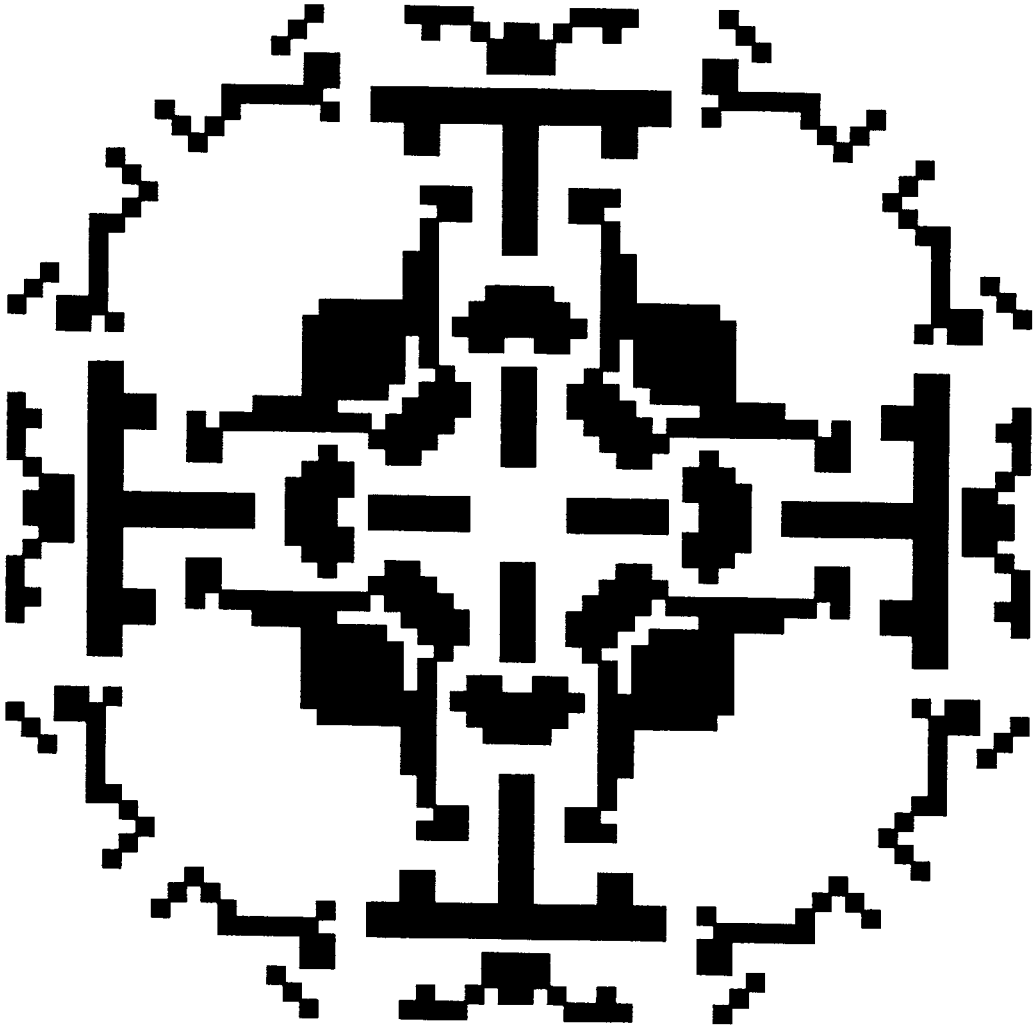
FIG. 13 is a fragmented aperture antenna designed by the two-step optimization process shown in FIGS. 5 and 6 and optimized for dual polarization over a 1.4–1.8 GHz frequency range.
Figure 14:
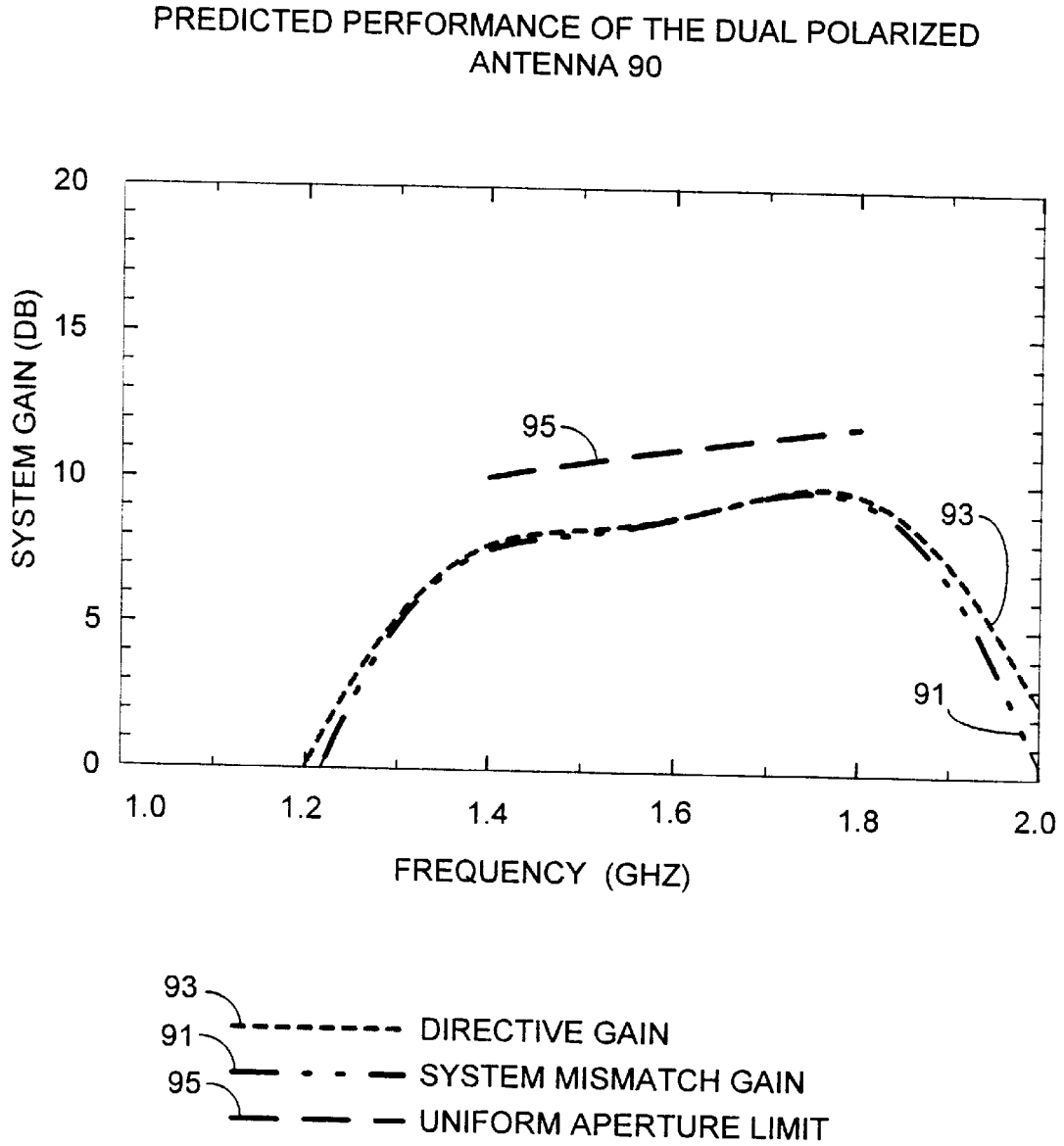
FIG. 14 is a graph of the predicted performance of the antenna displayed in FIG. 13.

The exemplar antenna designs 20, 75, 81 (FIGS. 3, 9 and 11) are all linearly polarized. The optimization process described above in FIGS. 5 and 6 may also be implemented to design a dual polarized antenna with a separate feed point for two linear polarizations. FIG. 13 is a non-limiting example of a fragmented aperture antenna 90 optimized for dual polarization over a 1.4–1.8 GHz frequency range. There are two sets of feed points (not shown) located in the center of the aperture. One set is oriented vertically and the other set is oriented horizontally. The two pairs form a cross shape. FIG. 14 is a graph 92 of the predicted performance of the antenna 90 displayed in FIG. 13. The broadside system and directed gains 91, 93, as shown in FIG. 14, both follow the uniform aperture limit 95.

The planar antennas discussed above naturally radiate equally in both broadside directions. For some applications, the backward radiation can be detrimental to the performance of the antenna. Scattering from supporting hardware behind the antenna can significantly influence the antenna performance in an unpredictable manner. As a non-limiting example, an antenna near a human body incurs electromagnetic loss because the body reduces the efficiency. Thus, a ground plane can be used to reduce the radiation in the backward direction and help alleviate this problem. For a narrow band antenna, this can simply be accomplished by placing a metallic conductor at $\lambda/4$ behind the antenna. The energy reflected from the ground plane adds constructively with the direct radiation to enhance the gain by 3 dB (for the ideal case of a ground plane infinite in an extent). However, as the bandwidth of the antenna increases, this solution does not always apply.

Figure 15:
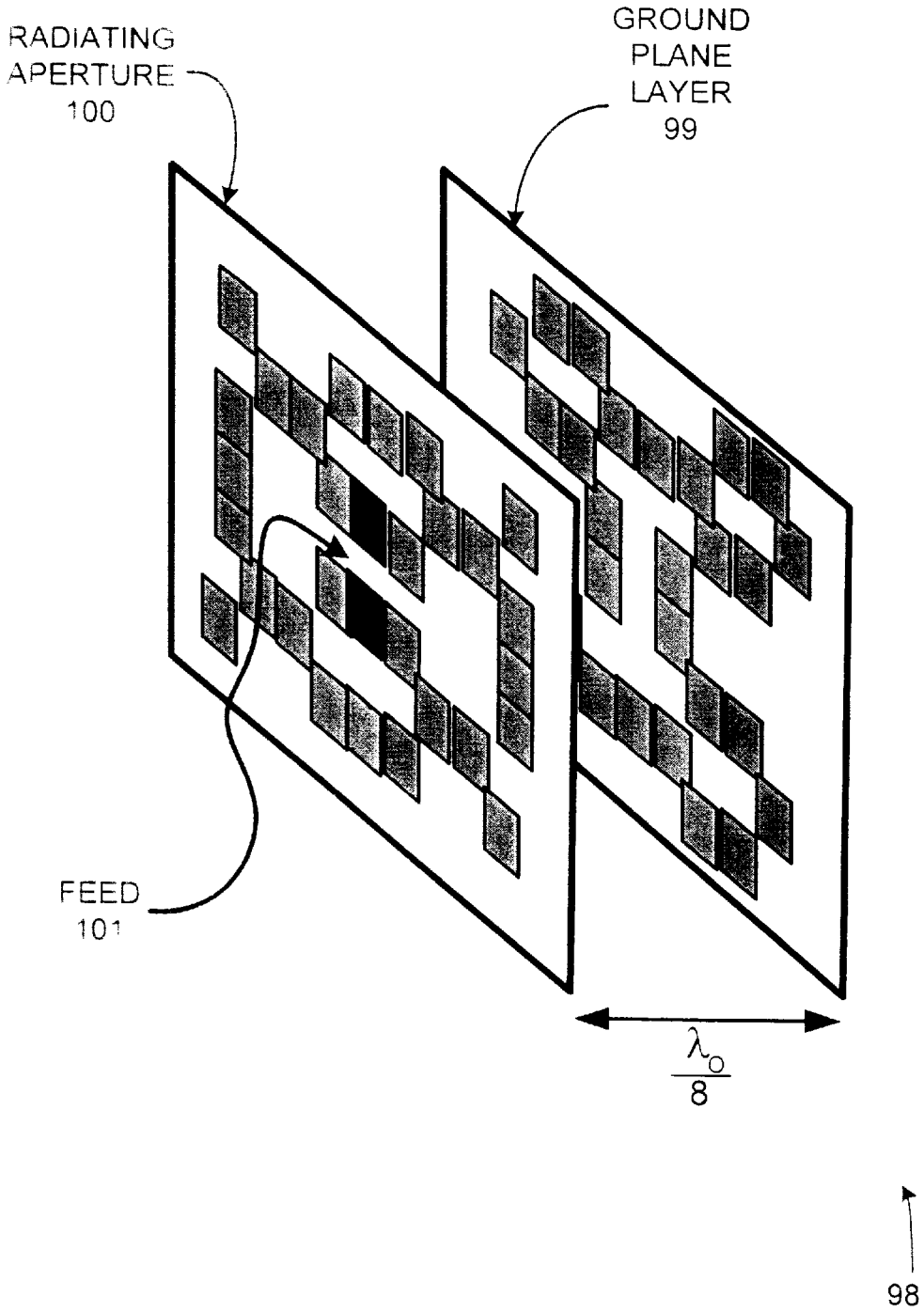
FIG. 15 is a diagram of an antenna designed by the two-step optimization process shown in FIGS. 5 and 6 with a fragmented ground plane.

In an alternative embodiment, a broadband ground plane is created by using a similar optimization strategy as described above in FIGS. 5 and 6 in regard to the design of a fragmented ground plane. The fragmented ground plane is a second patterned sheet placed behind the radiating layer to reflect the energy in the forward direction. FIG. 15 is a diagram of an antenna system 98 including antenna 100 with a fragmented ground plane 99. The fragmented ground plane 99 is a patterned layer similar to the radiating aperture 100 and is designed to operate as a ground plane over the bandwidth of the radiating aperture 100. Feed 101 is applied to the radiating aperture 100 and the ground plane layer 99 is placed in parallel to the radiating aperture 100 at a distance of $\lambda/8$ at the highest frequency. Ground plane 99 is designed after the radiating aperture 100 is created to simplify the optimization process.

Figure 16:
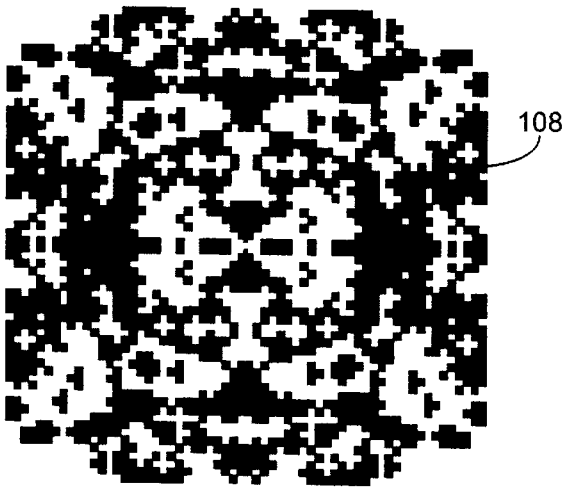
FIG. 16 is a diagram of two separate ground plane layers designed for the same radiating aperture.
Figure 16:
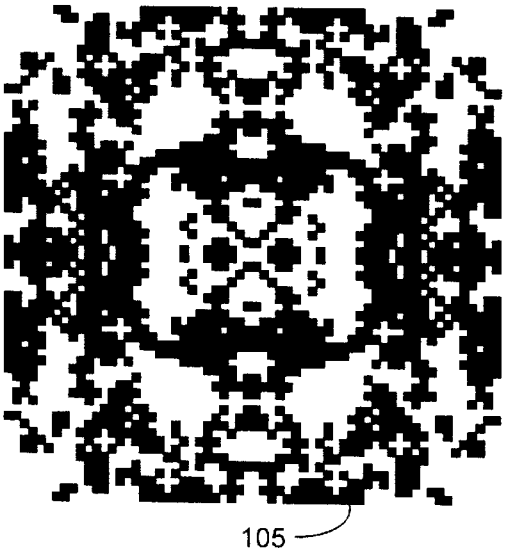
Figure 16:
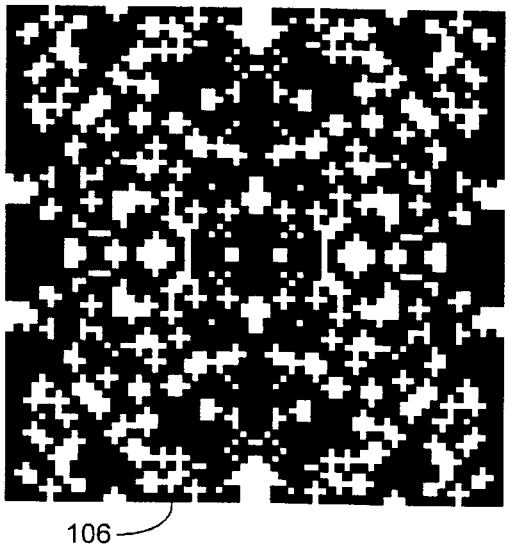

FIG. 16 is a diagram of two separate ground plane layers 105, 106 designed for the same radiating aperture 108. The ground plane 105 used the structure of the radiating aperture 108 as the starting point for the optimization process as described above which utilizes the stochastic hill climb method. The ground plane 106 was created through the optimization process described above and shown in FIGS. 5 and 6 based upon a solid metal sheet (not shown) as the starting point. While the ground plane layer structures 105, 106 are different, the results yielded by the ground planes are similar.

Figure 17:
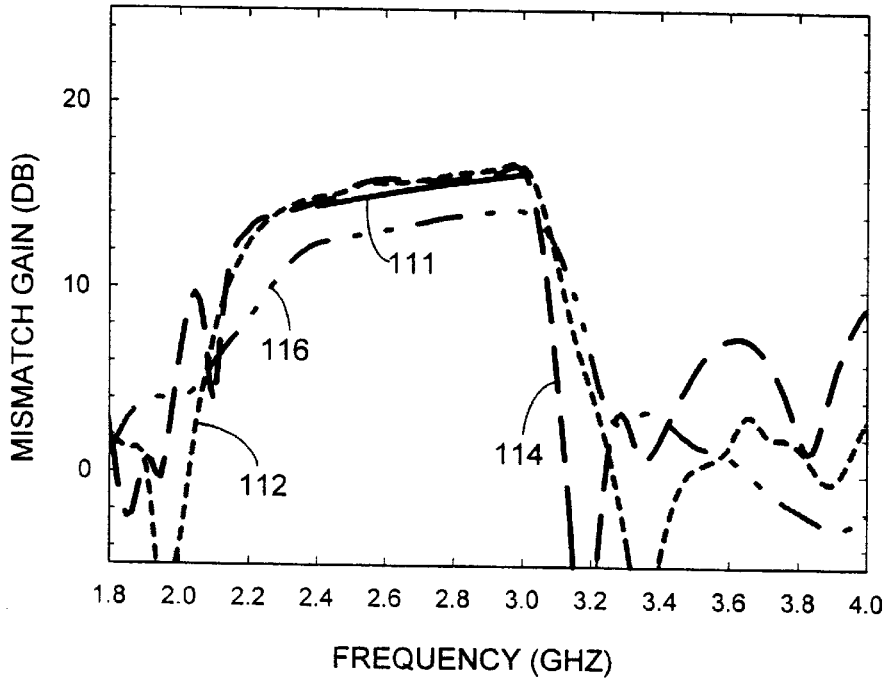
FIG. 17 is a graph of the performance of the fragmented aperture with the ground plane layers shown in FIG. 16 as compared to the uniform aperture limit.

FIG. 17 is a graph diagram 104 of the performance of the fragmented aperture 108 with ground plane layers 105, 106 as compared to the uniform aperture limit 111. The addition of either ground plane layer 105, 106 (FIG. 16) yields approximately 2.1–2.2 dB of improvement in the broadside gain 112, 114 of the antenna 108. As a comparison, line 116 is based on the performance of antenna 108 with no ground plane layer at all. There is, however, a slight increase in mismatch when the ground plane is added since the directivity actually improves by approximately 3 dB.

Figure 18:
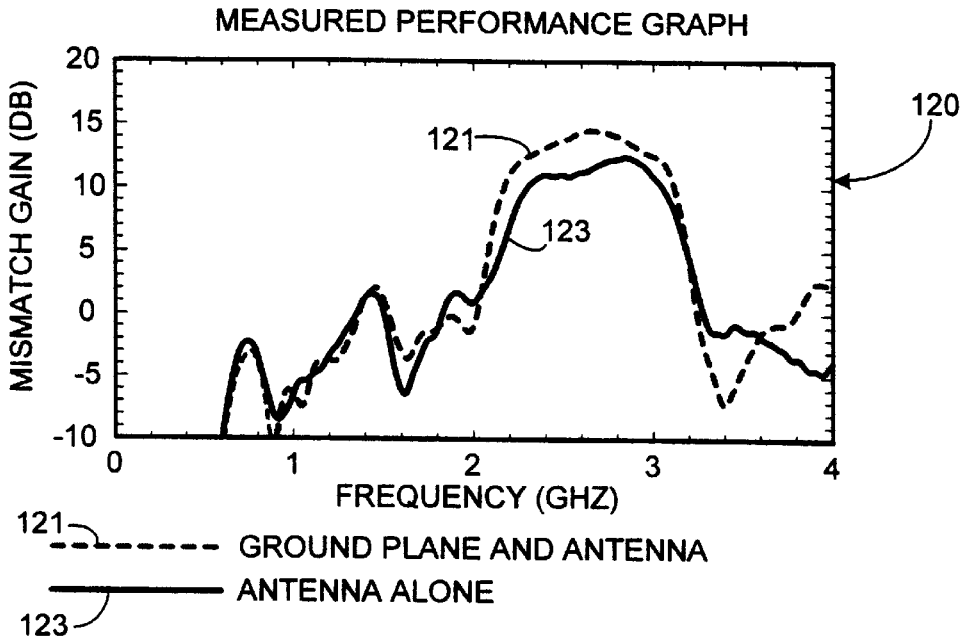
FIG. 18 is a graph of the measured performance of the fragmented aperture antenna in FIG. 16 with a ground plane to show performance improvement.
Figure 18:
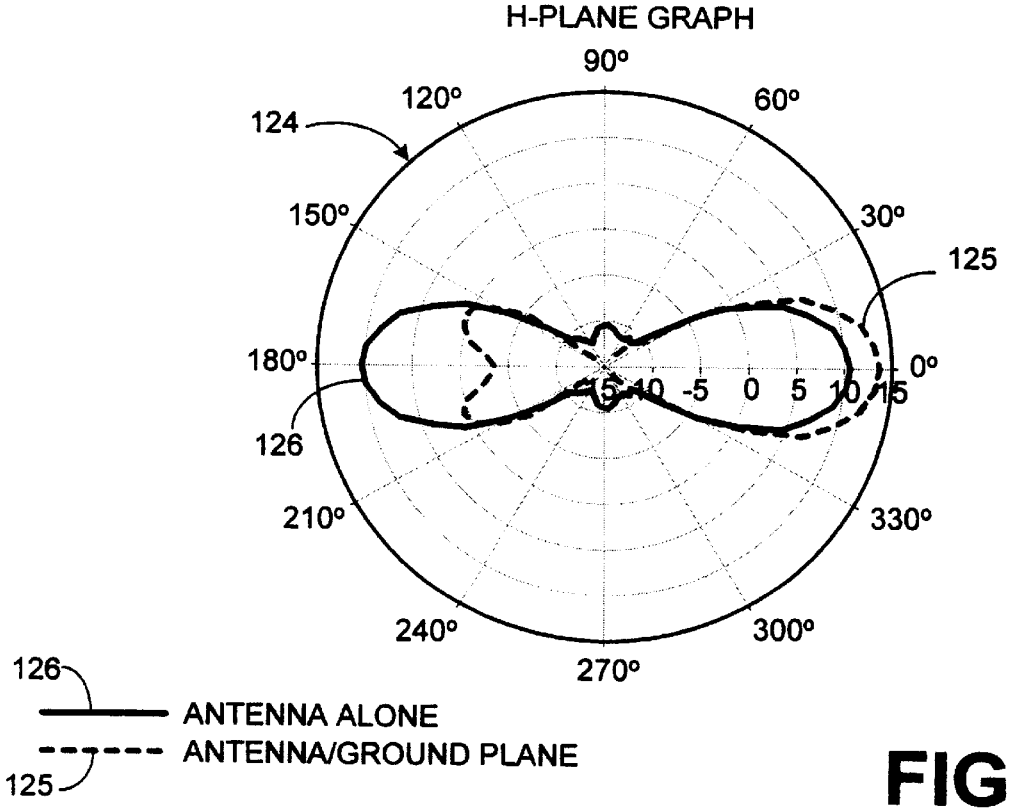

FIG. 18 is a graph diagram 120 of the measured performance of the fragmented aperture antenna 108 with ground plane 105 (FIG. 16) to show performance improvement. Line 121 represents the performance measurement of the antenna with the ground plane 105, and line 123 represents the performance measurement of the antenna without any ground plane. The measured results show the 2 dB of improvement with the fragmented ground plane 105. The result of including the ground plane layer 105 is a significant reduction in the radiation in the backward direction as evidenced by the horizontal pattern 124 in FIG. 18. In this diagram, the radiation pattern of the antenna with the ground plane layer 105 is represented by line 125, and the radiation pattern of the antenna without any ground plane layer is represented by line 126.

Figure 19:
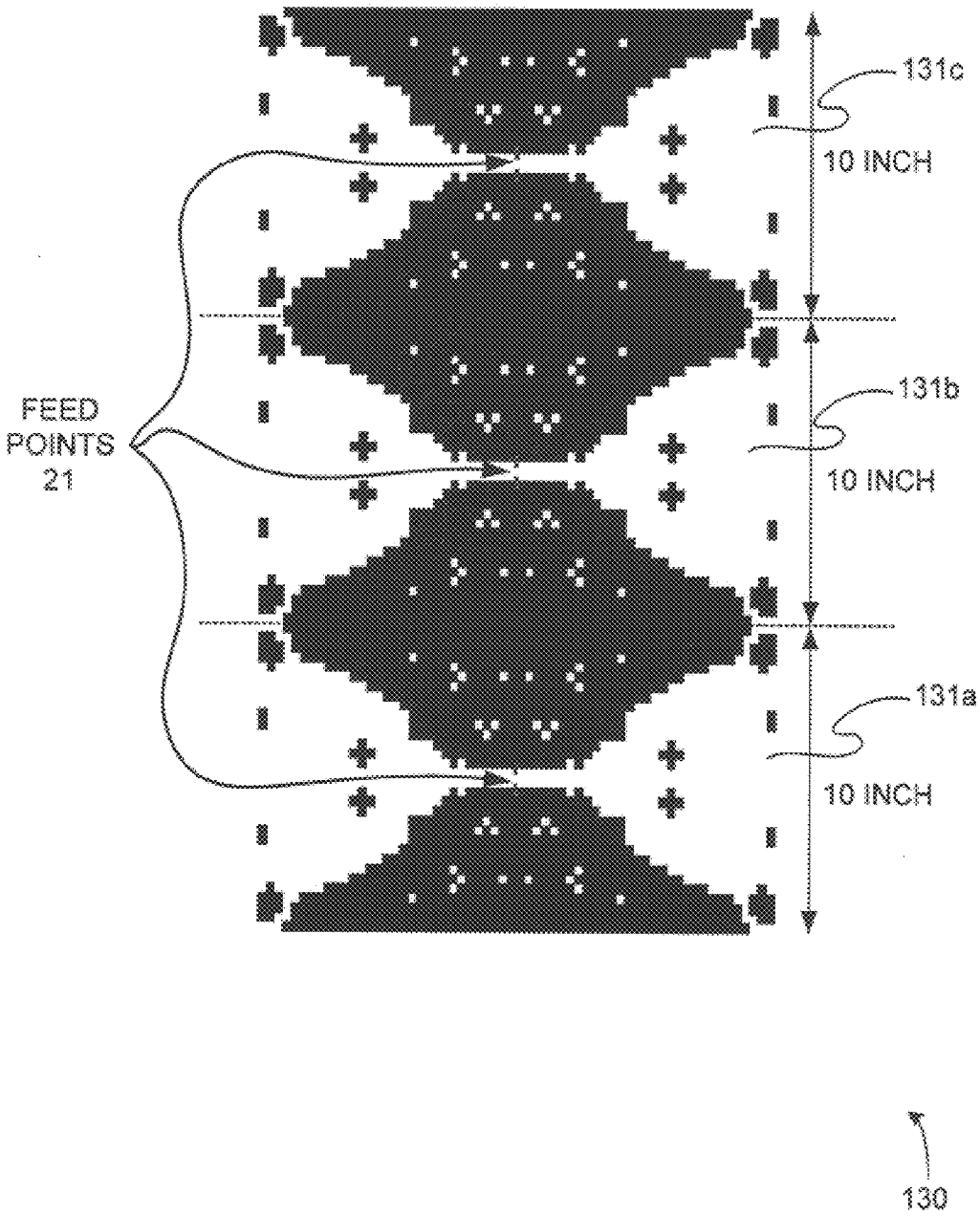
FIG. 19 is a diagram of three fragmented aperture antennas arranged in a connected antenna array similar to the antenna shown in FIG. 3.

The single fragmented aperture antenna as described above may also be placed in an array of multiple antenna elements. In one embodiment, the fragmented aperture antennas configured in the array environment are allowed, through the optimization process, to physically touch neighboring antenna elements, thereby creating a connected array. FIG. 19 is a diagram of three fragmented aperture antennas similar to the antenna shown in FIG. 3 arranged in a connected antenna array 130. To create the connected antenna array 130 in FIG. 19, a suitable antenna element is selected (based on bandwidth, gain, VWSR) and then the spacing and size are chosen such that no grating lobes exist and that the required array gain is met. The performance of the selected antenna array 130 is slightly modified by the presence of the neighboring antennas 131*a*, 131*b*, 131*c* (mutual coupling terms are small or manageable). In the connected array, the antenna elements 131*a*, 131*b*, 131*c* may physically touch, so the embedded array behavior does not resemble the isolated antenna behavior. By allowing the antenna elements 131*a*, 131*b*, 131*c* to touch, the low frequency limit of operation is not set by the size of the isolated elements, but rather, it is set by the size of the array antenna 130.

In focusing on the antenna array 130 in FIG. 19, as a non-limiting example, an array spacing of ten inches allows broadside operation up to approximately 1.2 GHz before the potential appearance of grating lobes. A traditional wideband antenna, such as an 8-inch bow-tie, will operate down to 250 MHz. The connected array elements 130, as in the non-limiting example in FIG. 19, are optimized to operate from 100 MHz to 1 GHz. The same two-step optimization approach discussed above and as shown in FIGS. 5 and 6 produces the antenna array 130 as shown in FIG. 19. The genetic design approach does not necessarily force the elements 131*a*, 131*b*, 131*c* to be connected; however, as evidenced in FIG. 19, the elements 131*a*, 131*b*, 131*c* are, in fact, connected.

Figure 20:
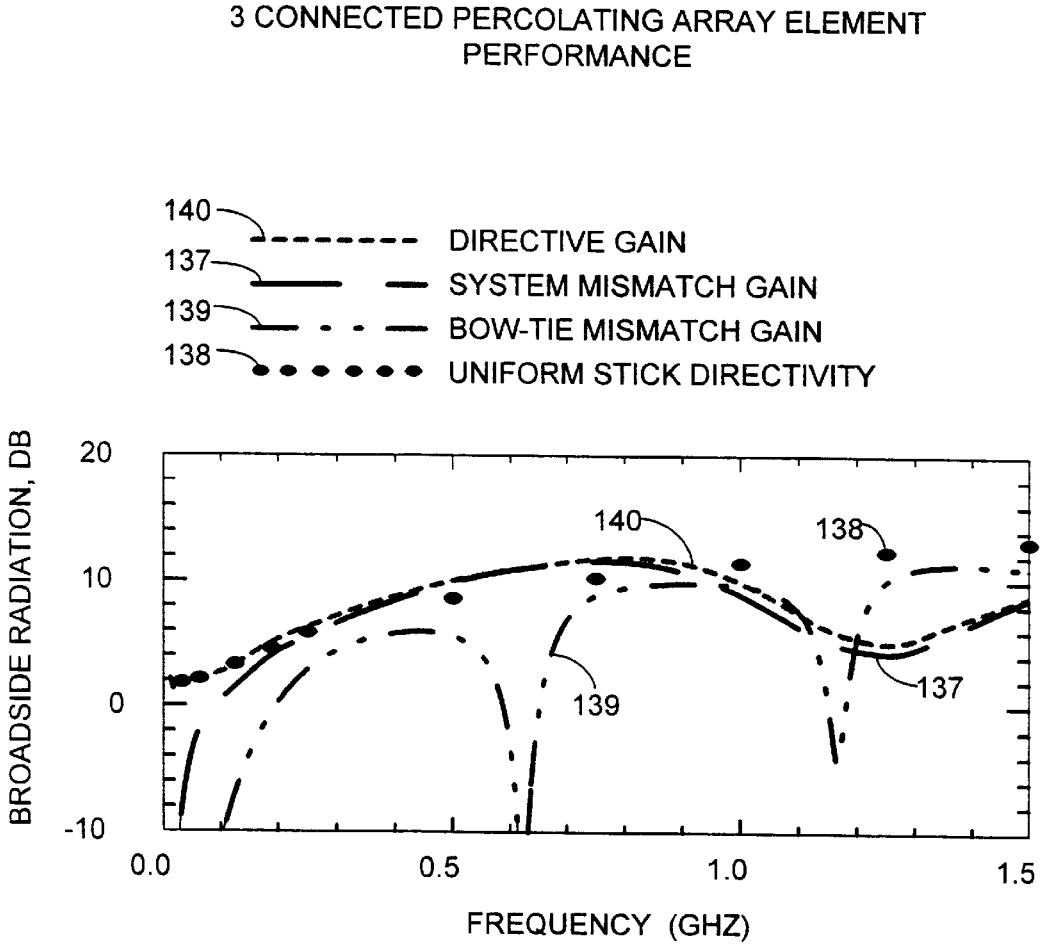
FIG. 20 is a graph of the performance of the antenna array shown in FIG. 19.

FIG. 20 is a graph 135 of the performance of the antenna array 130 shown in FIG. 19. The system mismatch gain 137 for the antenna array 130 is acceptable over the 100 MHz to 1 GHz frequency span, i.e., the performance tracks the uniform stick directivity 138. The performance of a comparable bow-tie antenna array is shown by line 139, and the directive gain of the antenna array is line 140. The performance of the connected array 130 is approximately 10 dB superior at the low frequency as compared to the performance of the bow-tie 139. The bow-tie antenna frequency drops out at 0.6 GHz, but this drop out is not present in the results of the connected antenna array 130, as shown by line 137. Finally, because the system gain 137 tracks the uniform stick directivity 138 closely, the diffraction-limited performance is achieved to below 100 MHz.

The discussion above in regard to fragmented aperture antennas illustrates the construction of aperture patterns that yield optimized performance over selected frequency bands. Another embodiment of the invention is herein discussed which realizes a reconfigurable aperture and achieves multiple fragmented aperture designs from a single aperture. The reconfigurable aperture offers the potential for wideband antenna designs.

Figure 21:
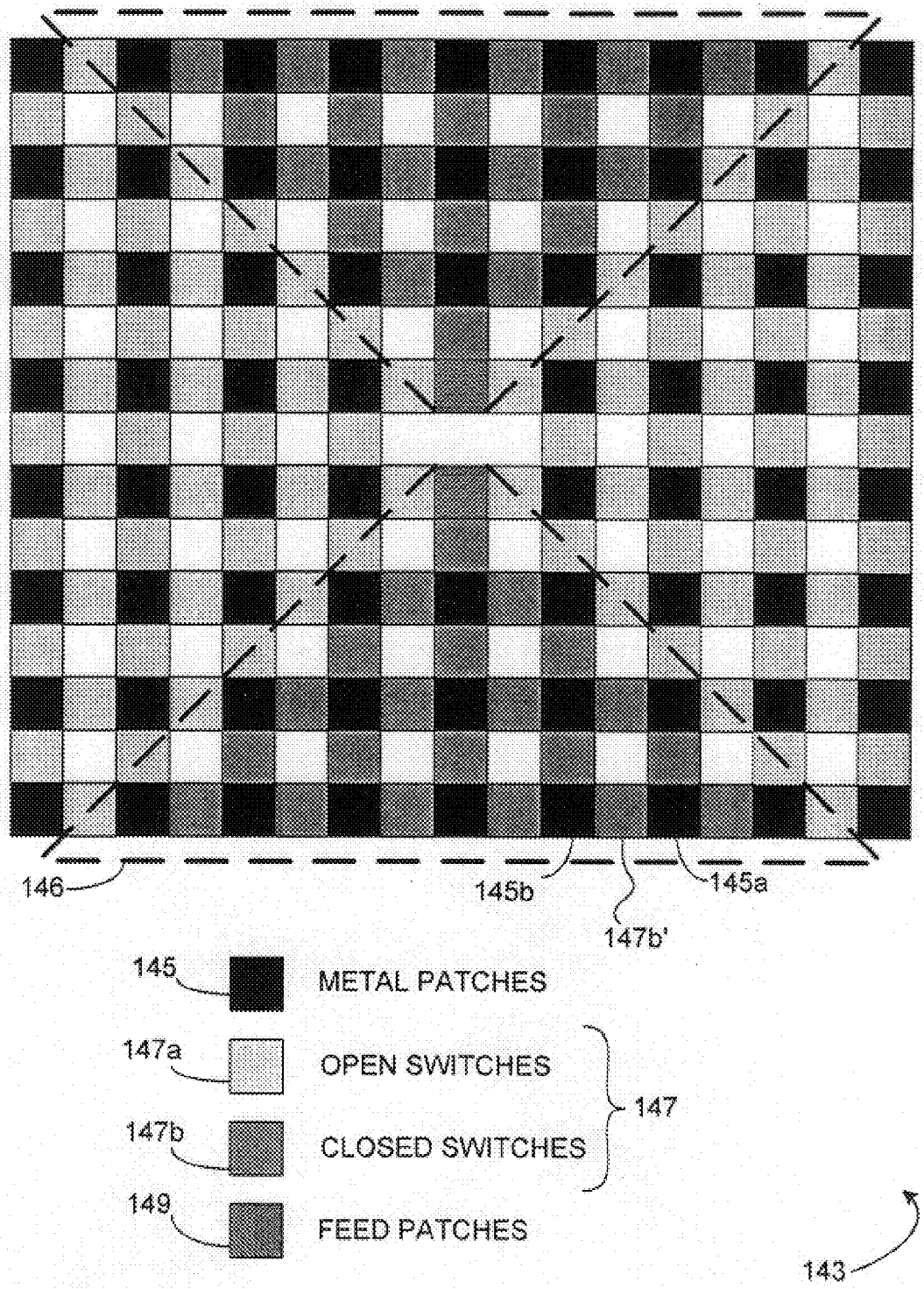
FIG. 21 is a diagram of a switched aperture antenna element arranged to form a fragmented aperture antenna similar to the antenna shown in FIG. 3.

FIG. 21 is a diagram of a switched aperture antenna element 143. The switched aperture antenna 143 includes a centrally located feed point 149 to transfer energy from the antenna. The antenna aperture 143 consists of a lattice of conducting patches 145 that are electrically small (approximately 1/20wave length) and connected by switches 147. The switches are opened 147*a* and closed 147*b* to configure the antenna 143. As a non-limiting example, conducting patch 145*a* is connected to neighboring connected patch 145*b* by switch 147*b*'. The configured antenna 143, in this non-limiting example, is similar to a traditional bow-tie antenna as shown by dashed lines 146. The switches 147 can be realized by using MEMS (Micro-Electromechanical Systems) devices, PIN diodes, latches, radio frequency (RF) transistors, or other similar devices known to those of ordinary skill in the art.

The switched aperture antenna 143 in FIG. 21 can be configured to realize optimized patterns arranged to operate over specific bands of frequency and directions of radiation. The expected performance of these designs should approach the levels achieved by the optimized fractured aperture antennas discussed above. In the preferred embodiment, the size of the aperture 143 is fixed to ten inches square, and the size of the individual metal patches 145 and switches 147*a*, 147*b* are four millimeters square.

Figure 22:
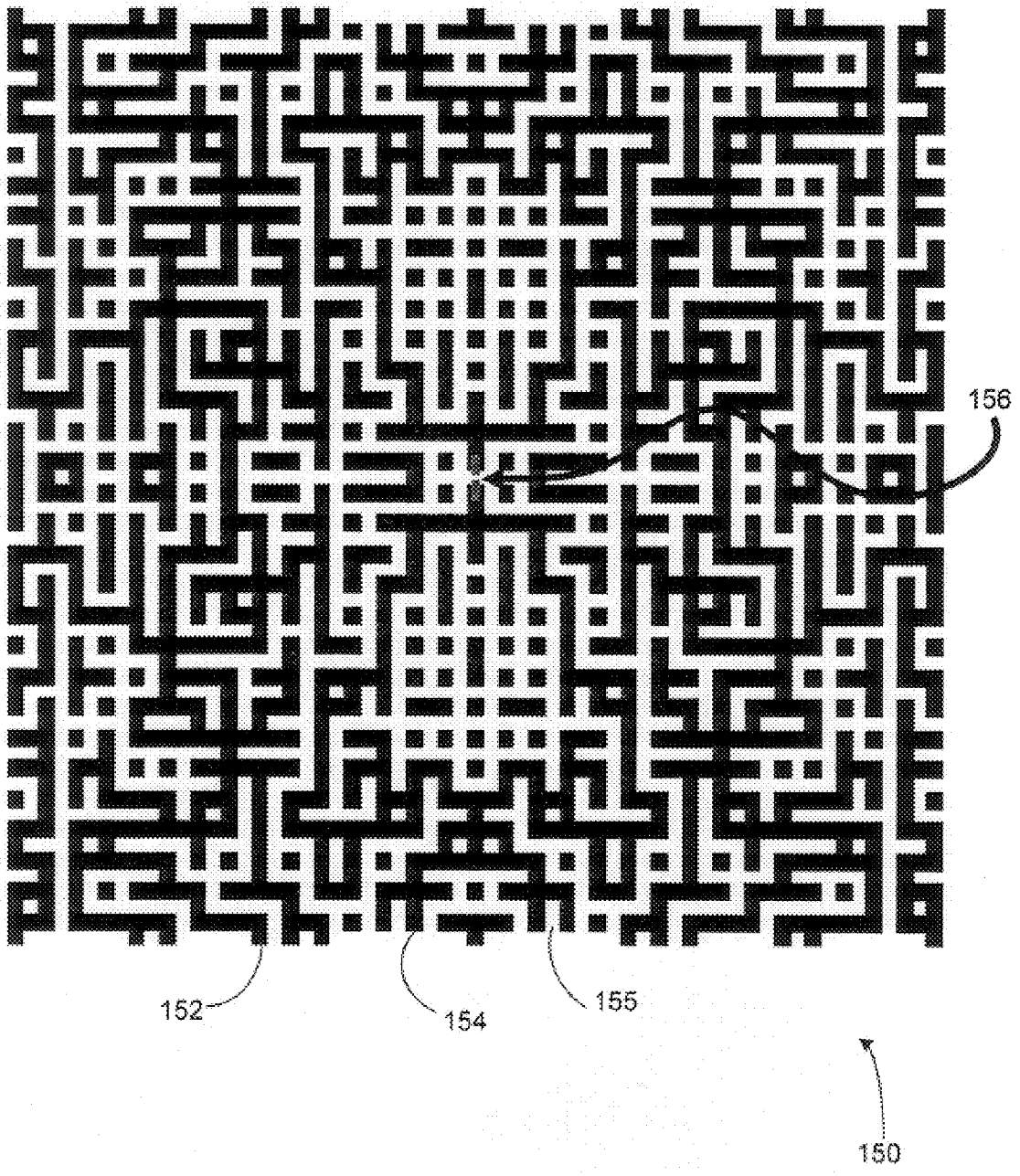
FIG. 22 is a switched aperture antenna similar to the antenna shown in FIG. 21 with several switches closed to realize an antenna created by the optimization process shown in FIGS. 5 and 6.
Figure 23:
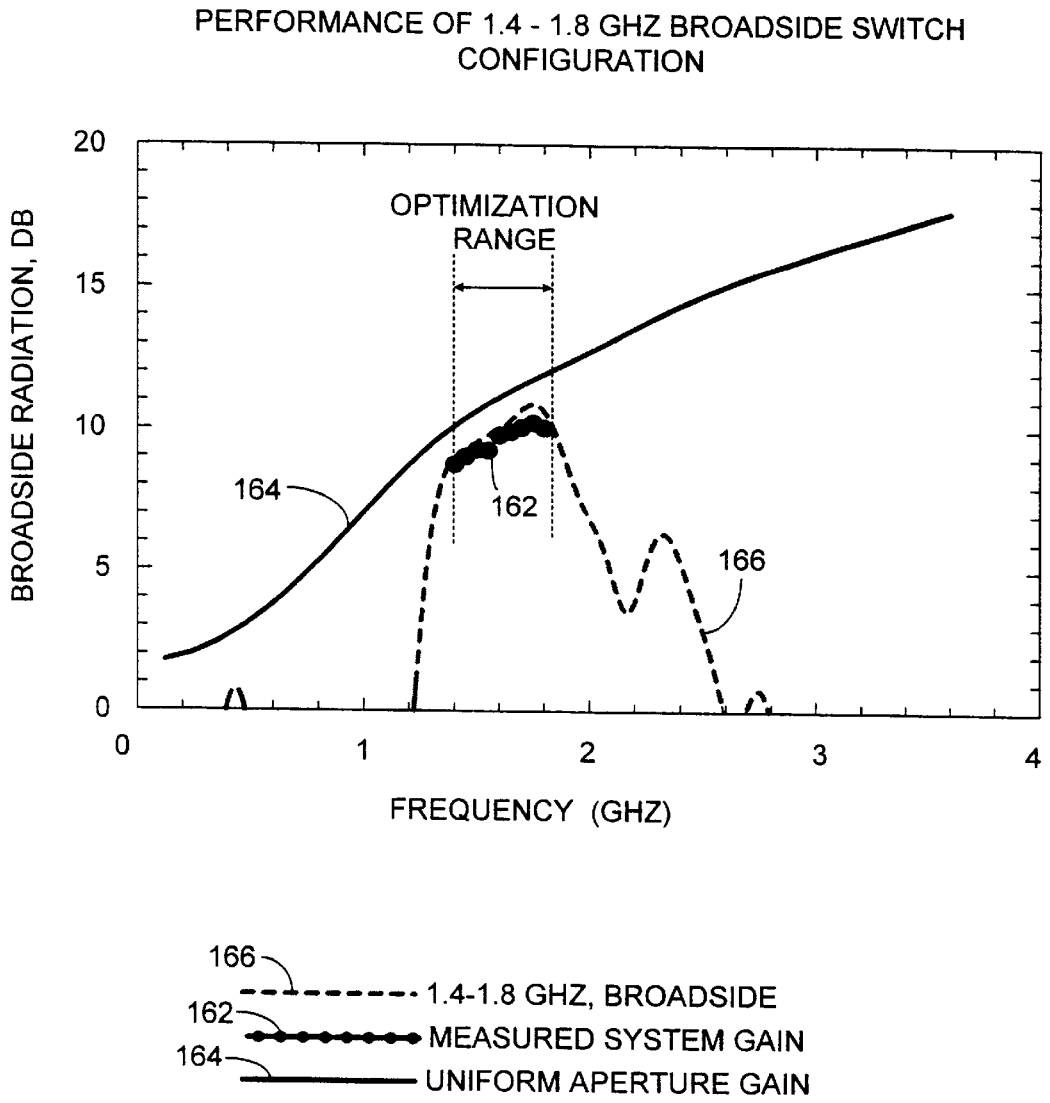
FIG. 23 is a graph of the performance of the switched aperture antenna in FIG. 22.
Figure 24:
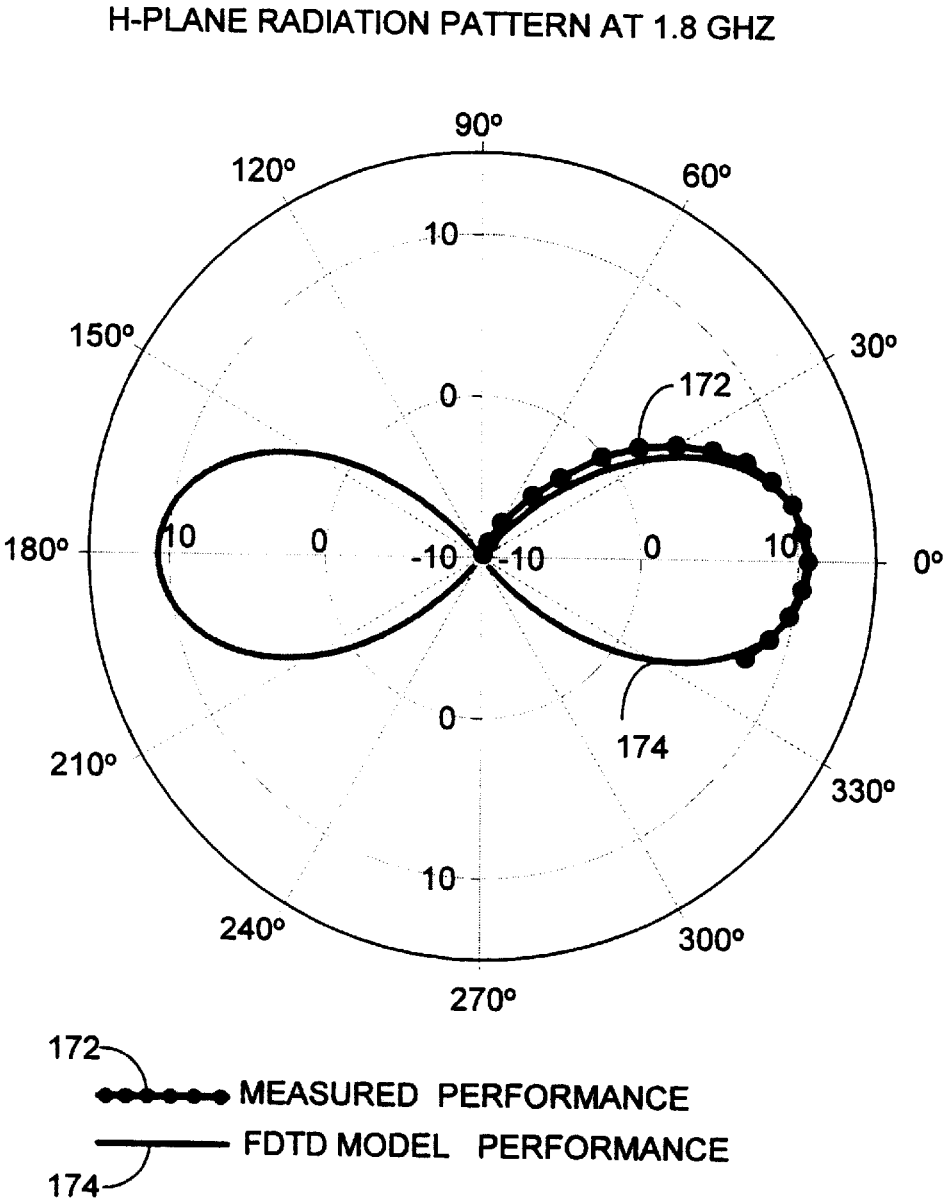
FIG. 24 is a graph of the H-plane radiation pattern of the switched aperture antenna in FIG. 22.

FIG. 22 is a switched aperture antenna 150 with the several switches 152 closed to realize an antenna created by the optimization process described above. This non-limiting aperture design 150 is configured to radiate broadside to have the best system gain over 1.4 to 1.8 GHz frequency range. Metal patches 154 are connected by closed switches 152 while open switches 155 are shown as blank space. Feed point 156 is connected at the center of the array 150. FIG. 23 is a graph 160 of the performance of the switched aperture antenna 150 as configured in FIG. 22. The system gain 162 of the switched aperture antenna 150 is shown in FIG. 23 as a function of frequency. The system gain 162 tracks the uniform aperture gain 164 closely over the 1.4 to 1.8 GHz optimization range, and is within 1 dB of this limit 164. The broadside gain is shown as line 166. As a result, the performance of the antenna array 150 in FIG. 22 is nearly diffraction limited. The H-plane radiation pattern 170 is shown in FIG. 24. The measured radiation pattern 172 is directed in the broadside direction as desired based upon the model pattern 174.

Figure 25:
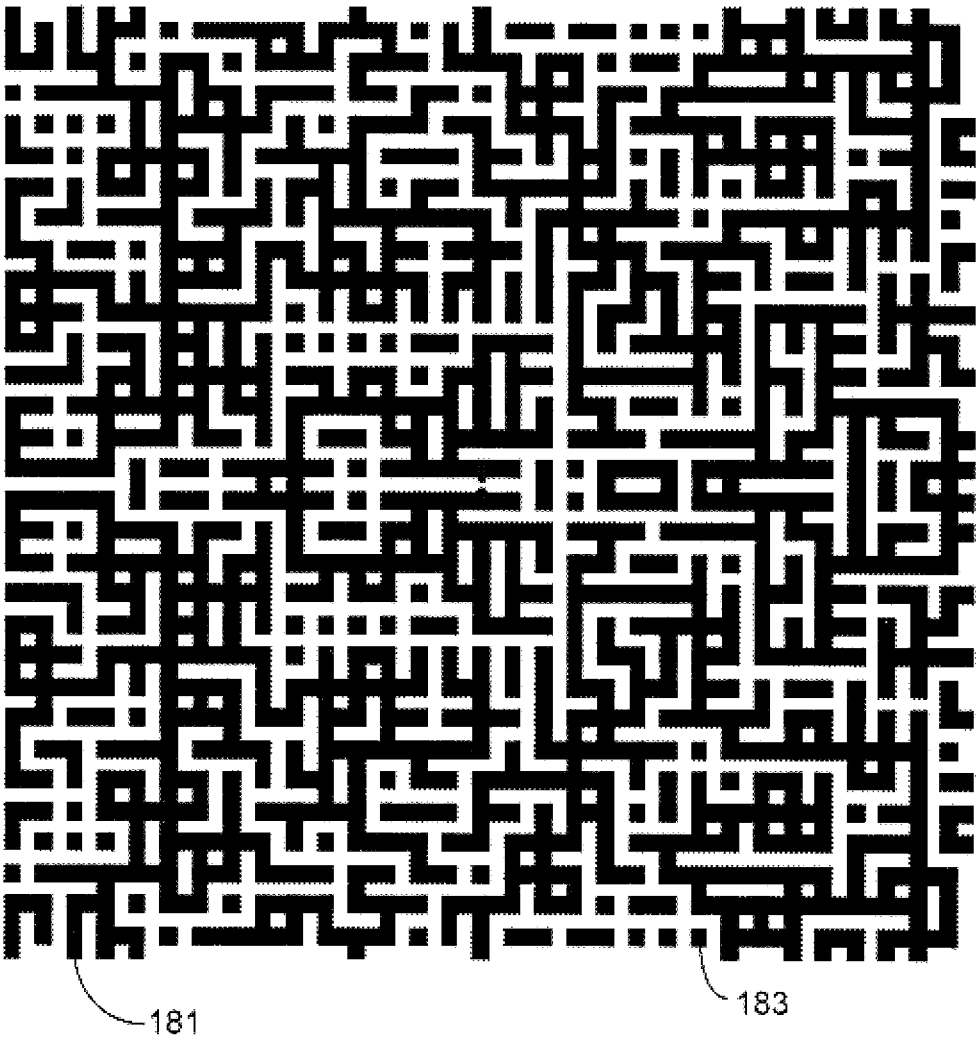
FIG. 25 is a diagram of a switched aperture antenna as in FIG. 21 for a 1.4 to 1.8 GHz frequency range for 30 degree steering.
Figure 25:
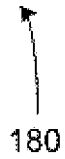
Figure 26:
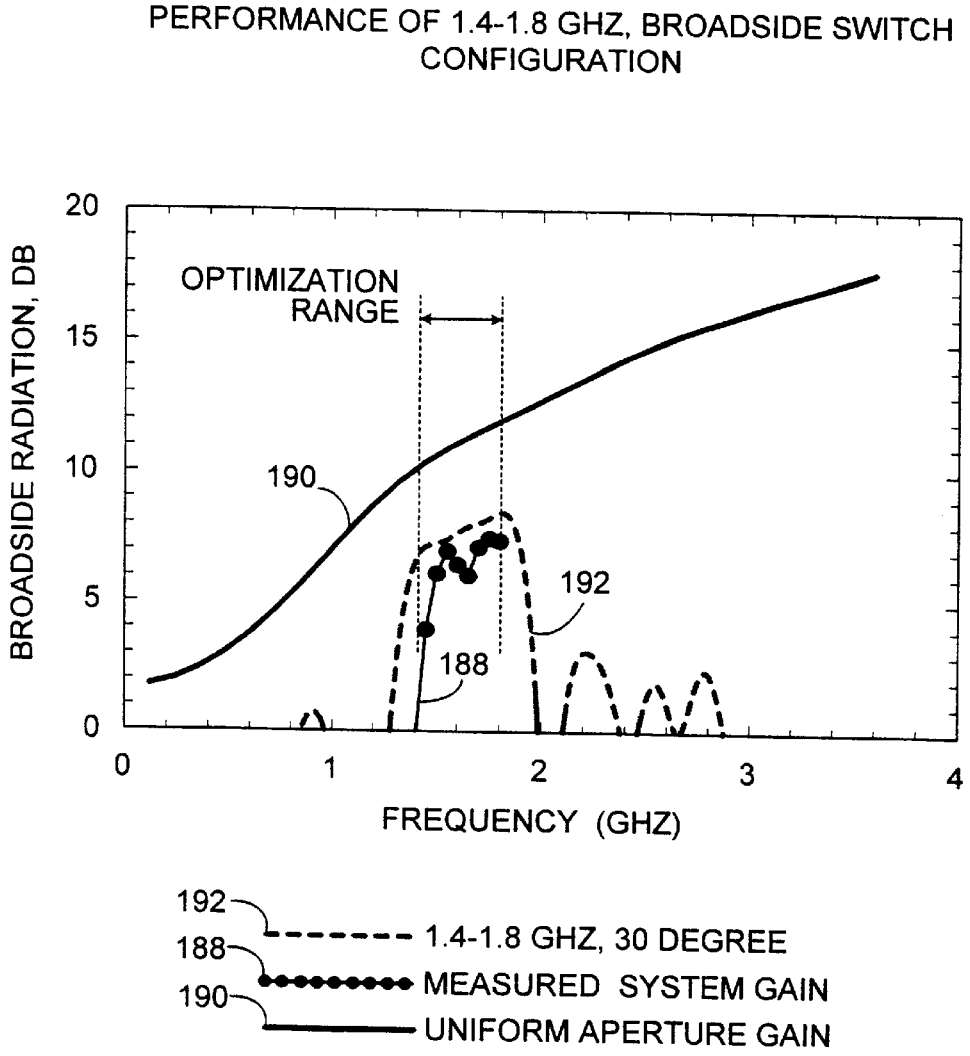
FIG. 26 is a graph of the measured system gain as a function of frequency for the antenna in FIG. 25.
Figure 27:
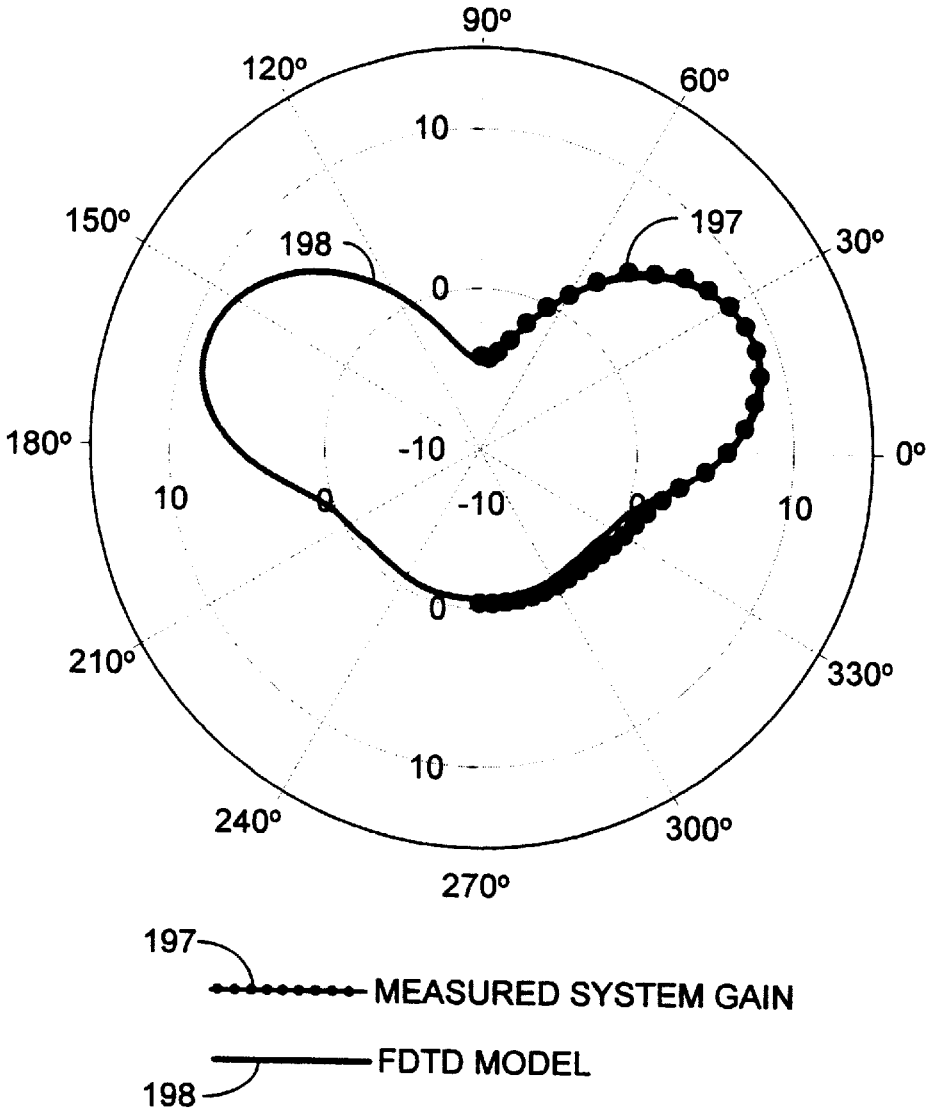
FIG. 27 is a graph of the H-plane radiation pattern for the antenna in FIG. 25 that is steered toward 30 degrees from broadside.

A switched aperture antenna configuration may also be designed to radiate at, as a non-limiting example, 30 degrees from broadside with a system gain over the 1.4 to 1.8 GHz frequency range. FIG. 25 is a diagram of a switched aperture antenna 180 for over a 1.4 to 1.8 GHz frequency range for 30 degree steering. As compared to the switched aperture 150 in FIG. 22, switches 181 are configured in a non-symmetrical arrangement to achieve the beam steering in the configuration that connects the conducting patches 183. The measured system gain 188 as a function of frequency is shown in the graph 185 of FIG. 26. The measured system gain 188 closely follows the predicted gain 192. The measured system gain 188 tracks the uniform aperture limit 190 over the 1.4 to 1.8 GHz optimization range. The H-plane radiation pattern 197 is shown in graph 195 in FIG. 27 and is clearly steered toward 30 degrees from broadside. As a result, the measured system gain 188 (FIG. 26) and H-plane radiation pattern 197 conform to the design predictions 198 based on the optimization procedure described above.

Figure 28:
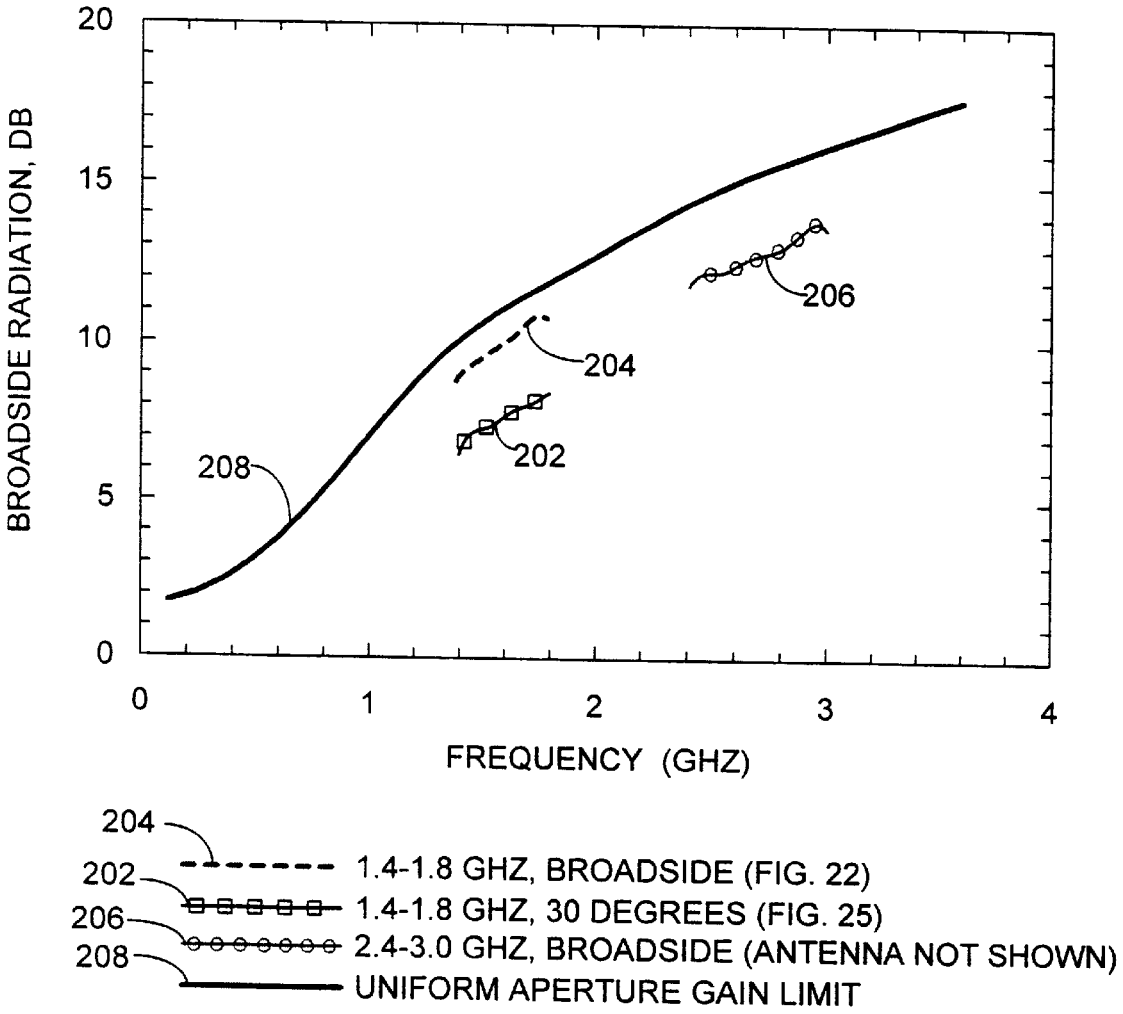
FIG. 28 is a graph of three potential system gains for the switched aperture antenna in FIG. 22, FIG. 25 and a third configuration not shown.

FIG. 28 is a graph diagram 200 of three system gains 202, 204, 206 for the switched aperture antenna 150 (FIG. 22), 180 (FIG. 25) and a third antenna optimized for a 2.4–3.0 GHz range (not shown). Thus, by arranging the switches of a switched aperture antenna in multiple configurations, the antenna can be modified to perform to different characteristics and still approach the uniform aperture gain limit 208 for different frequency ranges.

Figure 29:
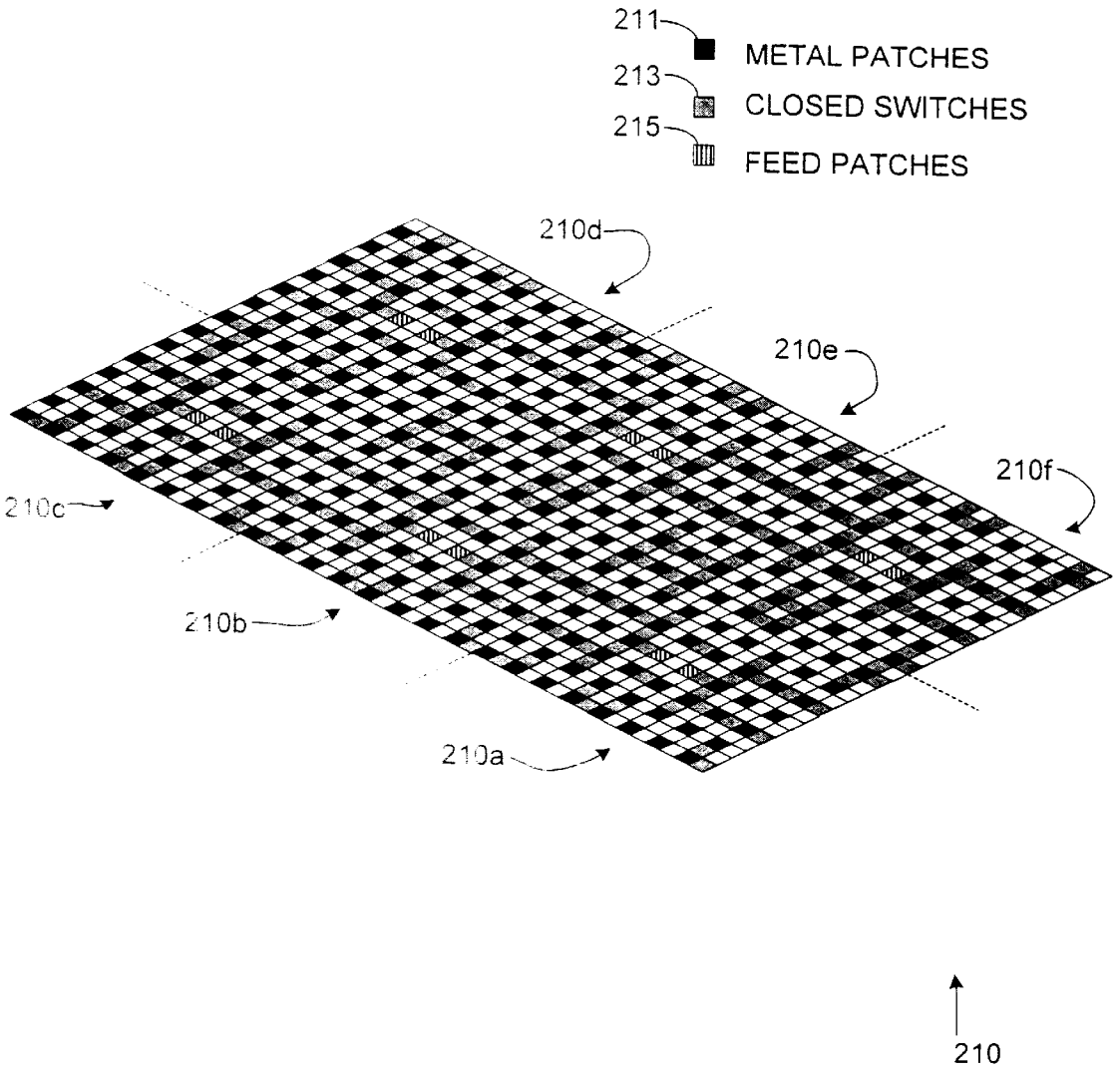
FIG. 29 is a diagram of a connected array of switched aperture antennas as shown in FIG. 22 to create a large configurable aperture.

Switched aperture antennas may also be constructed in a connected array such that a large configurable aperture is comprised of an array of identically smaller, reconfigurable elements as shown in FIG. 29. The fragmented aperture array structure 210 is a connected array similar to the connected non-switched arrays as discussed above. Metal patches 211 are connected by closed switches 213 to form the antenna array 210. Each of the antenna elements 210*a*–210*f* are fed by feed patches 215. In the fragmented aperture array 210, the antenna elements 210*a*–210*f* in the array may physically touch; hence, the embedded array behavior does not resemble the isolated antenna behavior. By allowing the elements 210*a*–210*f* to touch, the lower frequency limit of operation is not set by the size of the isolated element, but rather it is set by the size of antenna array. Thus, one configuration of a configurable array can operate broadband for a particular set of beam widths and steering angles, and the configuration of each array element can be changed from different beam widths and steering angles. Such an architecture has a significant cost reduction savings due to the repeated fabrication of a small pattern of patches and switches.

Antennas that can be described as 2-dimensional structures can be considered planar antennas. These antennas, if flexible, can also be considered conformal antennas, that is, they can be molded around objects and made to conform to the surface of the underlying structure. The type of antennas designed and fabricated as part of the screen printing subtask are all planar, conformal antennas.

Screen printing (also known as silk screen printing) is a process whereby ink is forced through tiny holes in a screen onto a substrate. The areas of the screen where one does not want inks coming through are covered with a solid epoxy. The ink dries and an image is bonded to the surface of the substrate. To create an antenna by screen printing techniques, the process may implement, as a non-limiting example, conductive inks containing silver particles or, as another non-limiting example, resistive inks containing carbon particles. Antenna ground planes may also be fabricated using the same inks.

Figure 30:
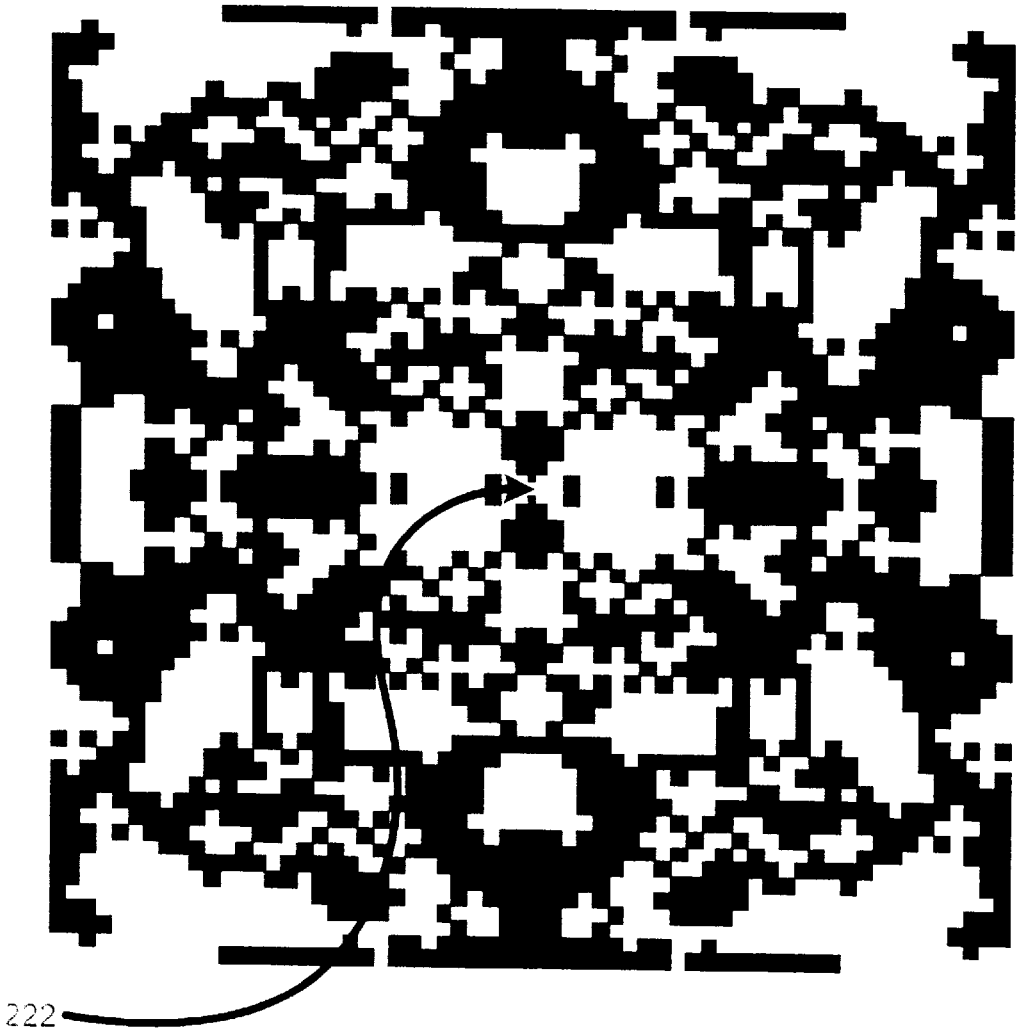
FIG. 30 is a fragmented aperture antenna created by the optimization process described in FIGS. 5 and 6 realized through screen printing techniques.

FIG. 30 is a fragmented aperture antenna 220 created by the optimization process described above and realized through screen printing techniques. Substrates such as Kapton, Tyvek, Polyester, and Mylar may be used as material receptive to the screen printing of the antenna. Feed 222 is centrally located similarly as described above. Antennas created by the optimization process described above in FIGS. 5 and 6 may be printed on these substrates for performances shown in the previous figures.

Any process descriptions or blocks in flow charts should be understood as representing modules, segments, or portions of code which include one or more executable instructions for implementing specific logical functions or steps in the process, and alternate implementations are included within the scope of the preferred embodiment of the present invention in which functions may be executed out of order from that shown or discussed, including substantially concurrently or in reverse order, depending on the functionality involved, as would be understood by those reasonably skilled in the art of the present invention.

The optimization process, as discussed above in relation to FIGS. 5 and 6, comprises an ordered listing of executable instructions for implementing logical functions, can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can contain, store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

Figure 5:
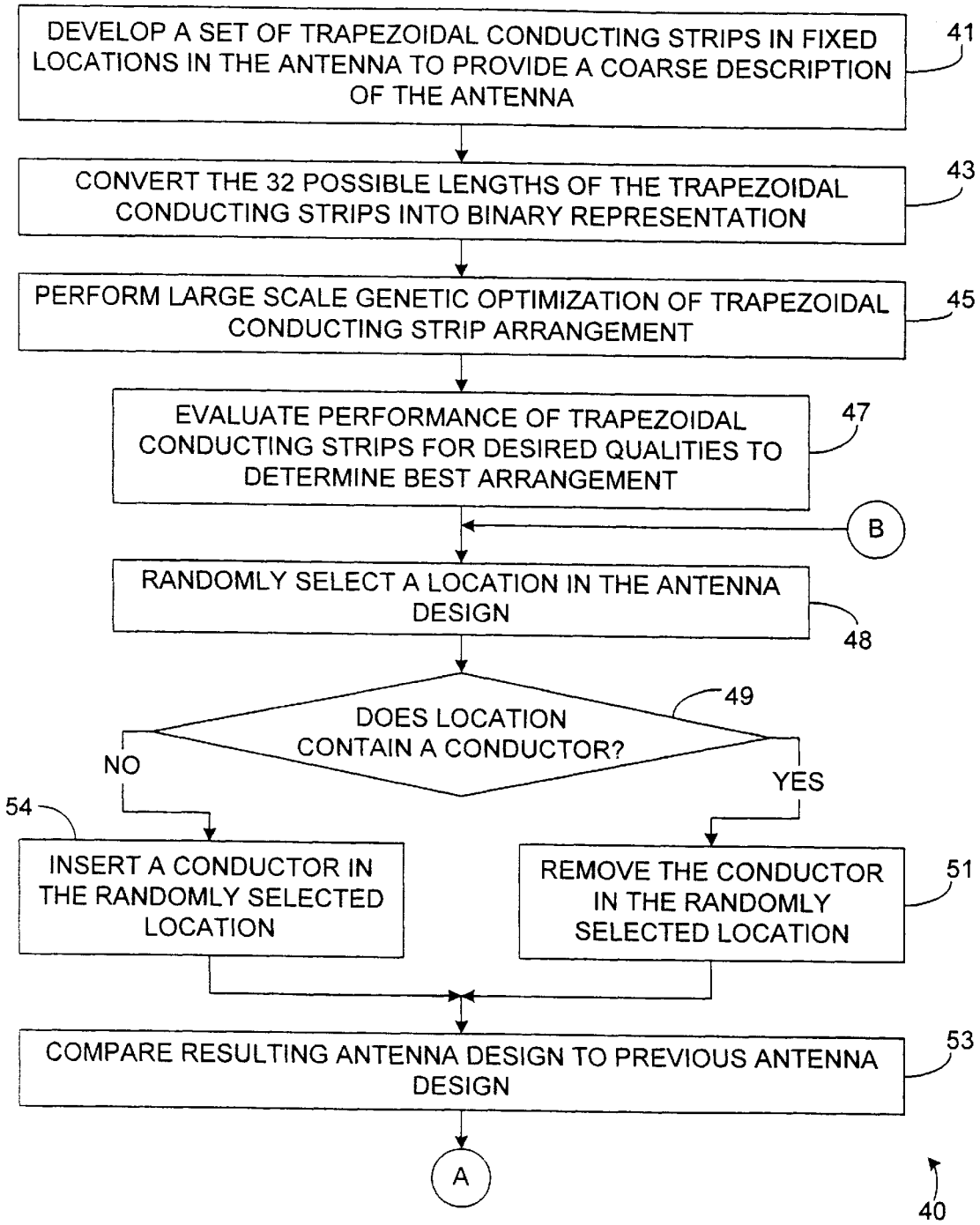
FIGS. 5 and 6 are flowcharts of the two-step optimization process implemented by the computer of FIG. 5 to create, for example, the antenna shown in FIG. 3.
Figure 6:
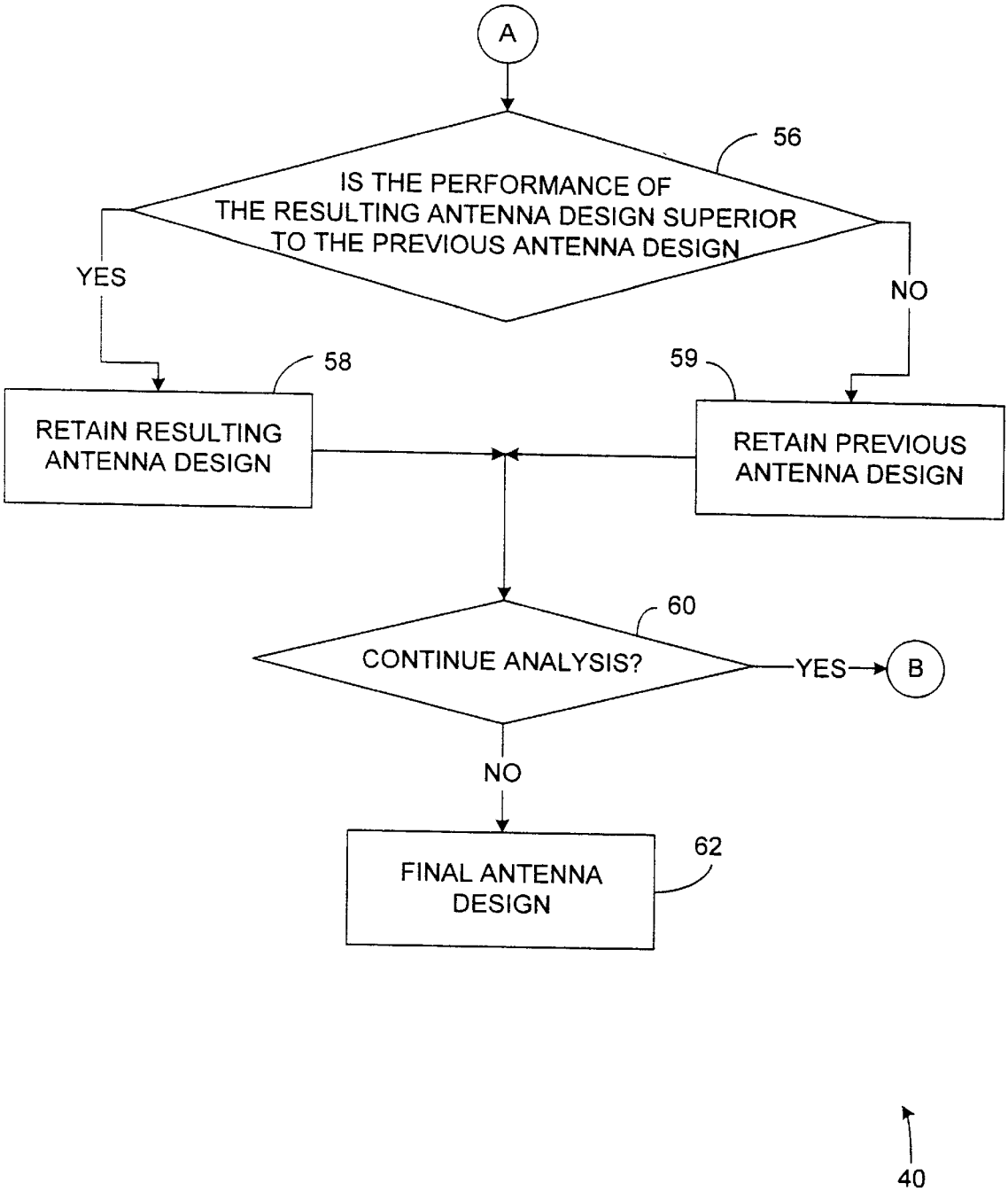
Figure 31:
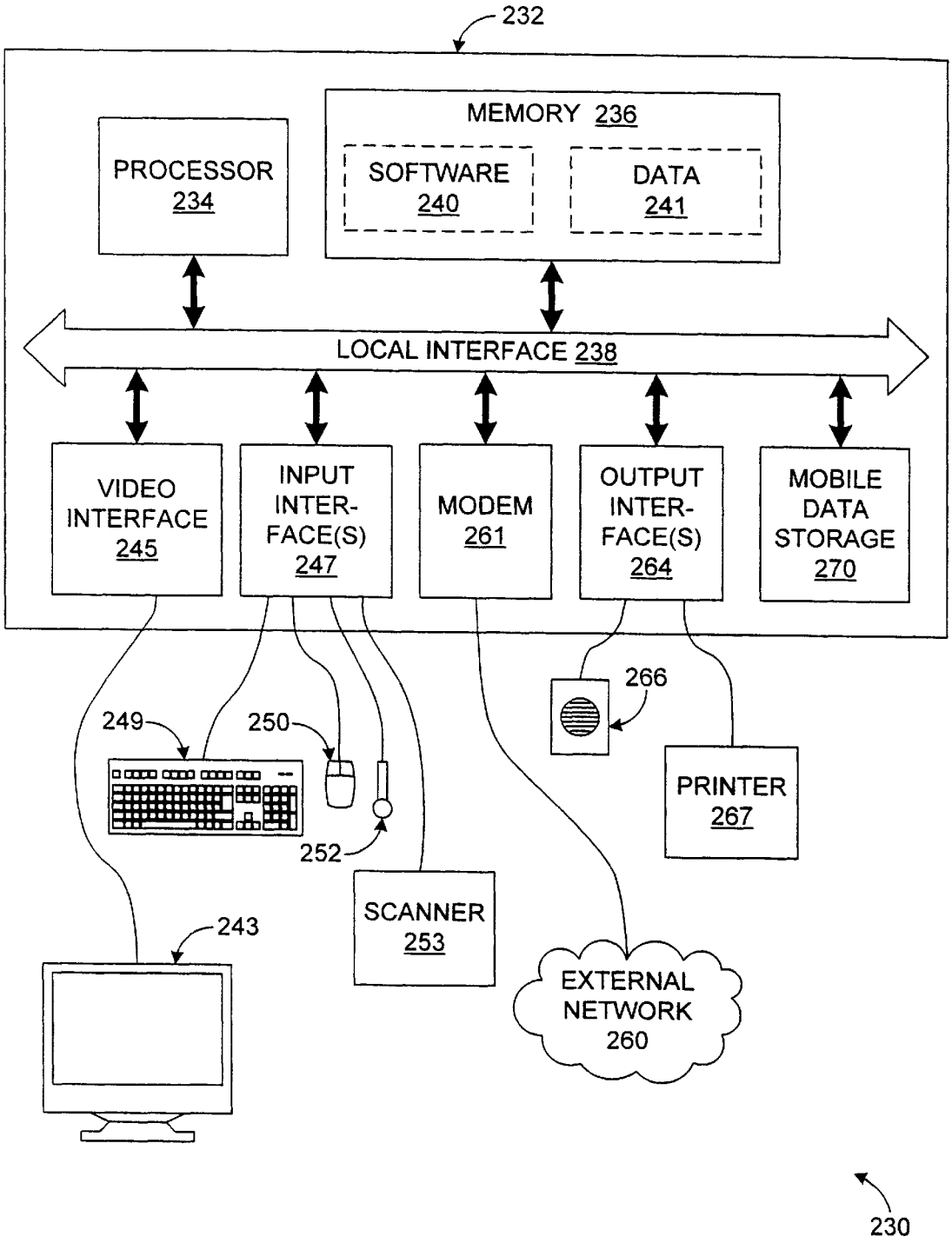
FIG. 31 is a diagram of a computer that may implement the optimization process as shown in FIGS. 5 and 6.

The optimization process as discussed above and as shown in FIGS. 5 and 6 may be implemented on a computer. FIG. 31 is a diagram of a computer 230 that may be utilized to implement the optimized process as shown in FIGS. 5 and 6. Housing 232 contains a processor 234 that accesses memory 236 via local interface bus 238. The memory 236 may store software 240 and other data 241. A monitor 243 is coupled by a video interface 245 to the bus 238 for presenting a display to the user. One or more input interface cards 247 may be coupled between the bus 238 and a keyboard 249, mouse 250, a microphone 252 and/or a scanner 253. The processor 234 may communicate with an external network 260 by a modem 261. An output interface card 264 may also be coupled to the local interface bus 238 for outputting audio to a speaker 266 and for outputting other data to a printer 267. A mobile data storage device 270 may be included in computer 230 and is coupled to the local interface bus 238.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

At least the following is claimed:

1. An antenna, comprising:

a planar layer having a plurality of first areas and a plurality of second areas, said first areas being more conductive than said second areas;

wherein each area has a periphery that extends along a grid of first and second sets of parallel lines so that each area comprises one or more contiguous elements defined by said lines; and wherein said first and second areas are configured and arranged so that said planar layer can communicate electromagnetic energy wirelessly in a specific direction to said planar layer when an electrical connection is made to at least one of said first areas.

2. The antenna of claim 1, wherein said first and second sets of parallel lines are orthogonal, said elements are squares, and each said area is a square, rectangle, or geometric region having orthogonally diverging contiguous segments.

3. The antenna of claim 1, wherein said first areas comprise a conductive or semiconductive material and said second areas comprise a dielectric or semiconductive material.

4. The antenna of claim 1, further comprising a switch capable of electrically coupling at least two of said first areas.

5. The antenna of claim 4, wherein the switch is a micro-electromechanical switch.

6. The antenna of claim 4, wherein the switch is a PIN diode.

7. The antenna of claim 4, wherein the switch is a radio frequency (RF) transistor.

8. The antenna of claim 4, wherein the switch is a latch switch.

9. The antenna of claim 4, wherein the antenna can be configured to realize optimized patterns arranged to operate over specific bands of frequency and directions of radiation.

10. The antenna of claim 1, further comprising one or more other planar layers serving as a ground plane and situated substantially parallel to said planar layer that communicates said electromagnetic energy.

11. The antenna of claim 10, wherein one or more of said other planar layers comprises pluralities of said first and second areas.

12. The antenna of claim 10, further comprising a switch capable of electrically coupling at least two of said first areas of said other planar layers.

13. The antenna of claim 1, further comprising one or more other planar layers situated adjacent to and substantially in the same plane as said planar layer so that said layers together can operate as an antenna array.

14. The antenna of claim 13, wherein the size and spacing of the antenna array is selected to reduce grating lobes.

15. The antenna of claim 1, wherein said first and second areas of said planar layer are symmetric about each of two orthogonal lines situated in the plane of said planar layer.

16. A method for making an antenna, comprising the steps of:

defining a planar grid defined by first and second sets of parallel lines so that the grid comprises a plurality of elements defined by the lines; and determining a first plurality of said elements that should be substantially conductive and a second plurality of said elements that should be substantially nonconductive so that a hypothetical antenna formed from said planar grid elements exhibits a desired frequency spectrum.

17. The method of claim 16, further comprising the steps of:

dividing said grid into a plurality of areas;

performing said determining step for one of said areas to derive a pattern of elements for said area; and replicating said pattern in other areas.

18. The method of claim 16, further comprising the step of utilizing a genetic code to perform said determining step.

19. The method of claim 18, further comprising the step of simulating the electromagnetic characteristics of said, antenna with a genetic sequence program.

20. The method of claim 16, further comprising the step of defining an antenna comprising:

a planar layer having a plurality of substantially conductive areas and a plurality of substantially nonconductive areas;

wherein each area has a periphery that extends along said grid so that each area comprises one or more of said elements defined by said lines; and wherein said areas are configured and arranged so that said planar layer can communicate electromagnetic energy wirelessly in a specific direction to said planar layer when an electrical connection is made to at least one of said conductive areas.

21. The method of claim 20, further comprising the step of evaluating an effect on said frequency spectrum of one or more other planar layers serving as a ground plane and situated substantially parallel to said planar layer that communicates said electromagnetic energy.

22. The method of claim 21, further comprising the step of evaluating an effect on said frequency spectrum of a switch capable of electrically coupling at least two elements of said other planar layers.

23. The method of claim 20, further comprising the step of evaluating an effect on said frequency spectrum of one or more other planar layers situated adjacent to and substantially in the same plane as said planar layer so that said layers together serve as an antenna array.

24. The method of claim 16, further comprising the steps of:

representing said elements of said grid with a set of bit values;

mapping a geometric shape having an area greater than one of said elements across said grid;

defining said bit values based upon said mapping; and performing said determining step based upon said bit values.

25. The method of claim 16, wherein said first and second sets of parallel lines are orthogonal and said elements are squares.

26. The method of claim 16, further comprising the step of defining areas with said elements, each said area being a square, rectangle, or geometric region having orthogonally diverging contiguous segments.

27. The method of claim 16, further comprising the step of evaluating an effect on said frequency spectrum of a switch capable of electrically coupling at least two of said conductive elements.

28. The method of claim 16, wherein said conductive and nonconductive elements are symmetric about each of two orthogonal lines situated in the plane of said grid.

29. The antenna of claim 16, wherein the substantially conductive element is conductive ink containing silver particles arranged on a substrate.

30. The antenna of claim 16, wherein the substantially conductive element is resistive ink containing carbon particles arranged on a substrate.

31. The antenna of claim 16, wherein the planar grid is flexible so that it can be molded to conform to the shape of three dimensional objects.

32. An antenna made by the process of:

arranging a plurality of conducting strips in an optimized sequence according to desired performance quality for said antenna; and modifying conductor configuration at one or more randomly selected locations on said antenna until said antenna acquires said desired performance quality.

33. The antenna of claim 32, wherein a conductor is removed if said location contains a conductor, wherein a conductor is inserted if no conductor is contained in said location.

34. A two-stage process to synthesize a design of a fragmented aperture antenna in three dimensions using a computer, the process comprising the steps of:

loading a computer with a genetic algorithm model and an electromagnetic code, the genetic algorithm model being a preselected set of permutations of alternative geometric configuration possibilities for a fragmented aperture antenna within a three-dimensional volume and wherein the electromagnetic code is a correlation model that correlates fragmented aperture antenna prospectives from genetic antenna configurations;

specifying to the computer a desired set of electromagnetic antenna element properties;

directing the computer to identify a first set of fragmented aperture antenna designs from the fragmented aperture antenna prospectives by testing the preselected set of permutations proposed by the genetic algorithm using in three dimensions the electromagnetic code;

directing the computer to identify a final set of fragmented aperture antenna designs from the first set of fragmented aperture antenna designs by testing the first set of fragmented aperture antenna designs by the genetic algorithm using in three dimensions the electromagnetic code;

selecting a fragmented aperture antenna design from the final set of fragmented aperture antenna designs; and wherein the fragmented aperture antenna is quadrantly symmetrical with a centrally located transmission feed line.

35. A process to synthesize a design of a printed fragmented aperture antenna in three dimensions using a computer, said process comprising the following steps:

loading an algorithm comprising a space of possible solutions represented by some representational scheme which, by some iterative process, will converge to an optimal solution, to be used in conjunction with an electromagnetic code onto a computer;

specifying a desired set of electromagnetic properties for the fragmented aperture antenna element to be designed;

defining size, geometry and/or features of said fragmented aperture antenna;

specifying a sample population size to be randomly or otherwise selected from among all possible fragmented aperture antenna configurations based upon said size, geometry, and/or features of said fragmented aperture antenna;

computing electromagnetic properties of a plurality of conducting and non-conducting elements in each fragmented aperture antenna configuration in three dimensions in the sample population using the electromagnetic code and rank solutions in order of performance, wherein the fragmented aperture antenna comprises a centrally located transmission feed;

modifying the population by a method that brings the population incrementally closer to an optimum solution;

repeating this iterative process a specified number of generations or until the population fitness reaches equilibrium which is considered an optimal solution.

* * * * *